US009642461B2

(12) United States Patent
Goetz et al.

(10) Patent No.: US 9,642,461 B2
(45) **Date of Patent: *May 9, 2017**

(54) DRIVE DEVICE FOR A MOVABLE FURNITURE PART

(71) Applicant: Julius Blum GmbH, Hoechst (AT)

(72) Inventors: Christof Goetz, Lustenau (AT); Florian Fischer, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/847,278

(22) Filed: Sep. 8, 2015

(65) Prior Publication Data

US 2015/0374125 A1 Dec. 31, 2015

Related U.S. Application Data

(63) Continuation of application No. PCT/AT2014/000057, filed on Mar. 26, 2014.

(30) Foreign Application Priority Data

Apr. 12, 2013 (AT) ..... A 292/2013

(51) Int. Cl.
*A47B 95/00* (2006.01)
*A47B 88/04* (2006.01)
(Continued)

(52) U.S. Cl.
CPC ..... *A47B 88/0477* (2013.01); *A47B 88/463* (2017.01); *A47B 88/47* (2017.01); *A47B 88/49* (2017.01); *A47B 88/57* (2017.01)

(58) Field of Classification Search
CPC . A47B 88/0477; A47B 88/0481; A47B 88/08; A47B 88/16; A47B 88/0466;
(Continued)

(56) References Cited

U.S. PATENT DOCUMENTS 4,828,344 A 5/1989 Omata
5,040,833 A * 8/1991 Brunnert ..... A47B 88/0477 292/80
(Continued)

FOREIGN PATENT DOCUMENTS

CA 2 743 055 12/2012
CN 102413733 4/2012
(Continued)

OTHER PUBLICATIONS

International Search Report issued Jul. 14, 2014 in corresponding International Application No. PCT/AT2014/000057 (with English translation).
(Continued)

*Primary Examiner* — Hanh V Tran
(74) *Attorney, Agent, or Firm* — Wenderoth, Lind & Ponack, L.L.P.

(57) ABSTRACT

A drive device for a moveable furniture part includes an ejection element, an ejection force accumulator, and a locking device for the ejection element. The locking device has a locking journal which is subjected to action of the ejection force accumulator, and can be locked in a locked position in a region of a catch on a guide rail. The catch area has a locking pin which is fixed with respect to the guide rail. The locking journal which is subjected to the force of the ejection force accumulator is arranged in the catch region such that it can be slowed down and/or dampened.

25 Claims, 44 Drawing Sheets

(51) Int. Cl.

| | |
|---|---|
| ***A47B 88/463*** | (2017.01) |
| ***A47B 88/47*** | (2017.01) |
| ***A47B 88/49*** | (2017.01) |
| ***A47B 88/57*** | (2017.01) |

(58) Field of Classification Search
CPC ... A47B 88/0407; A47B 88/14; A47B 88/463; A47B 88/47; A47B 88/49; A47B 88/57; E05B 65/463
See application file for complete search history.

(56) References Cited

U.S. PATENT DOCUMENTS

| | | | | |
|---|---|---|---|---|
| 5,144,963 | A | 9/1992 | Dabringhaus et al. | |
| 5,306,081 | A * | 4/1994 | Fukumoto | B60K 37/04 312/222 |
| 7,347,515 | B1 * | 3/2008 | Lu | A47B 88/0477 312/319.1 |
| 7,374,261 | B1 * | 5/2008 | Wang | A47B 88/0477 312/319.1 |
| 8,534,781 | B2 | 9/2013 | Netzer et al. | |
| 8,807,671 | B2 * | 8/2014 | Brunnmayr | A47B 88/16 312/319.1 |
| 9,295,329 | B2 * | 3/2016 | Brunnmayr | A47B 88/0481 |
| 2007/0090735 | A1 * | 4/2007 | Hashemi | A47B 88/0477 312/334.46 |
| 2009/0072687 | A1 | 3/2009 | Fitz | |
| 2009/0284113 | A1 * | 11/2009 | MacElveen | A47B 88/0477 312/319.1 |
| 2010/0026152 | A1 * | 2/2010 | Huang | A47B 88/0477 312/319.1 |
| 2011/0129172 | A1 * | 6/2011 | Liang | A47B 88/0422 384/22 |
| 2011/0215690 | A1 * | 9/2011 | Juan | A47B 88/08 312/319.1 |
| 2012/0001441 | A1 * | 1/2012 | Juan | A47B 88/0477 292/164 |
| 2012/0038255 | A1 * | 2/2012 | Netzer | A47B 88/0477 312/319.1 |
| 2012/0319412 | A1 | 12/2012 | Liang et al. | |
| 2013/0334946 | A1 | 12/2013 | Netzer et al. | |

FOREIGN PATENT DOCUMENTS

| | | |
|---|---|---|
| DE | 10 2011 002 212 | 10/2012 |
| EP | 0 483 590 | 5/1992 |
| EP | 0 766 939 | 4/1997 |
| JP | 2012-239738 | 12/2012 |
| WO | 2007/112463 | 10/2007 |
| WO | WO 2012/149587 | * 11/2012 |

OTHER PUBLICATIONS

Austrian Search Report issued Dec. 4, 2013 in corresponding Austrian Application No. 292/2013 (with English translation).
Austrian Search Report issued Nov. 26, 2014 in corresponding Austrian Application No. 215/2014 (with English translation).

* cited by examiner 19
1
OS
4
36
37
54
41
28
16
7
6
E
45
53
3=15
14
56
9
55
53
7
54
43
29
S
E
45
79
A
Ü
R

OS + V

OS

OS

OS

SS+V

OS

SS+V

DRIVE DEVICE FOR A MOVABLE FURNITURE PART

BACKGROUND OF THE INVENTION

The invention concerns a drive device for a moveable furniture part comprising an ejection element, an ejection force storage means and a locking device for the ejection element. The locking device has a locking pin which is acted upon by the ejection force storage means and which is lockable in a locking position in a latching region of a guide path. The invention further concerns an article of furniture comprising a furniture carcass, a furniture part moveable relative to the furniture carcass, and the drive device for the moveable furniture part.

Drive devices for ejecting a moveable furniture part from a closed position into an open position have already been known for many years in the furniture fitting industry. To guarantee that the ejection element or the moveable furniture part is securely held in a closed position, locking devices are provided in that arrangement. When opening of the moveable furniture part is wanted, the locking device can then be unlocked by actuation of a triggering mechanism. Unlocking can be effected for example by pressing against the moveable furniture part to push it into an over-pressing position. Triggering or unlocking is also possible by pulling. After such unlocking, an ejection force storage means can deliver its force and in so doing move the moveable furniture part in the opening direction by way of the ejection element.

After the ejection force storage means has been relieved of its load upon opening of the moveable furniture part, that ejection force must be restored to the ejection force storage means again by stressing. That is generally effected when closing a moveable furniture part (but it can also be effected upon opening) by an operator who moves the moveable furniture part by hand. When therefore a pressing force is applied to the moveable furniture part upon closure thereof, pressure is also applied against the force of the ejection force storage means. As soon as the ejection force storage means is fully stressed the locking pin of the locking device passes along the guide path into the latching region, in which case then the hand no longer holds the ejection force storage means in its stressed position but the locking pin locks or holds the stressed ejection force storage means in the locking position at the latching region.

A possible way of unlocking by pulling is known from DE 10 2011 002 212 A1 which relates to a different kind of drive device. According to that specification, a spring element having a limb is arranged in the latching recess or the spring element contributes to forming the latching recess. That spring element yields in relation to a force which is transmitted by the latching pin and which acts in the opening direction so that the latching pin is no longer locked in the latching recess but presses against the spring element and passes through a gap which has become free in the latching recess. With only a relatively slight force acting on the spring element, the spring element can also achieve a certain damping action in the abutting condition. A disadvantage with that variant, however, is that particularly with a strong closing force or a high closing speed a damping action which is at most present is of no avail. Rather, with a strong closing force or a high closing speed, this arrangement does not guarantee secure locking of the latching pin in the latching recess, but it involves immediate—unwanted—unlocking by pulling.

Therefore, the present invention further concerns a drive device in which the latching region has a latching recess which is fixed in position relative to the guide path—in other words the latching pin cannot pass therethrough. This means that the latching pin cannot pass through the latching recess as the latching recess forms a fixed or substantially stationary part of the locking device. This means that unwanted opening by pulling when there is a strong closing force or a high closing speed cannot occur.

In contrast, such a latching recess which is fixed in position is known from WO 2007/112463 A2. In addition, the object of the specification is to provide that a locking element of a drive device is transferred into a latching position provided in a guide path without unnecessary material wear and without excessive generation of noise. For that purpose, a drawer is braked by a damping device before a force storage member acting on the drive device is loaded. In other words, prior to loading of the force storage member, the closing movement is just so firmly braked that the residual energy is still sufficient to load the force storage member whereby the locking element is not locked—that is to say, damped—upon full movement of the moveable furniture part.

A critical region in terms of stressing and locking is, however, also not implemented in this specification, namely the region immediately prior to reaching the locking position in the latching region. More specifically, if the latching pin, by virtue of the configuration of the guide path, passes into a region shortly before reaching the latching region, then the fully loaded ejection force storage means can act with its full force on that locking pin, in which case that then comes into an abutment condition in the latching region with the production of a relatively large amount of noise and heavy wear.

SUMMARY OF THE INVENTION

Therefore, the object of the present invention is to provide a drive device which is improved over the state of the art. In particular the invention seeks to provide that locking can be effected as quietly as possible. The invention further seeks to provide that locking can be effected with the lowest possible loading on the components involved.

Accordingly, the locking pin which is acted upon by the stressed ejection force storage member can be placed in a latching recess of the latching region in braked and/or damped relationship. Accordingly, the full force of the ejection force storage member no longer acts on the locking pin when the latching region is reached, but the movement of the locking pin is damped or braked before or upon reaching the latching region. In other words, in a locking device with a fixed latching recess (fixed relative to the guide path in the base plate), there is a latching pin movement damping or braking effect, instead of or in addition to a drawer closing movement damping effect.

In principle, such damping or braking can be provided in any kind of locking device having a locking pin and a guide path. Such braking or damping of the locking pin is particularly necessary, however, in a cardioid-shaped guide path. With such a cardioid-shaped guide path, the cardioid-shaped guide path has a stressing portion in which the locking pin is moveable upon stressing of the ejection force storage member and a latching engagement movement region of the locking pin before the locking position in the latching region is reached. The latching region is spaced in the opening direction of the moveable furniture part from a transitional region which is between the stressing portion and the latching engagement movement region, preferably by between 0.2 mm and 3 mm. As the locking pin can be uncoupled, preferably completely, from a movement of the moveable furniture part as from reaching the transitional region, and as therefore the locking pin is moveable into the latching region by the ejection force storage member along the latching engagement movement region, it is precisely that spacing between the transitional region and the latching region in the previous cardioid-shaped guide paths that is the reason that relatively severe striking and locking noises occur by virtue of the high force which acts on the locking pin from the ejection force storage member. The greater the force of the ejection force storage member, the louder and more disturbing the locking noises can be. That is now prevented by the braking or damping action in respect of the locking pin.

In principle, a plurality of different ways in which the locking pin can be placed in the latching region in braked or damped relationship are conceivable.

A first variant includes a damping device which is operative between the ejection force storage member and the locking pin, and which damps the kinetic energy transmitted from the ejection force storage member into the locking pin before the locking position is reached. Thus, it is not the full energy that is transmitted to the locking pin as from attainment of the transitional region. In other words, the kinetic energy acting on the locking pin is reduced by the damping device. It is particularly preferable for that purpose that the kinetic energy acting on the locking pin is reduced by the damping device only in the latching engagement movement region of the locking pin. That damping device also does not have to damp the movement of the locking pin in the entire latching engagement movement region, but can also damp it only in a part of that region. In a particularly preferred embodiment of such a damping device, the damping device is in the form of a travel transmission mechanism. Thus, it is not the entire energy that is immediately transmitted to the locking pin from the ejection force storage member. That can be effected for example by an arrangement whereby the locking pin can be placed in the latching region in cam-controlled relationship by the travel transmission mechanism, and the travel transmission mechanism has a control cam by which the kinetic energy acting from the ejection force storage means on the locking pin is preferably steadily increased along the latching engagement movement region depending on the control cam. In a further variant for this slow delivery of the energy from the ejection force storage member to the locking pin, a damper, for example in the form of a linear damper, is arranged for example in the region of the ejection force storage member or at its head. Thus, the first part of the stress relief travel of the ejection force storage member is from full stressing to almost full stressing which is achieved in the closed position.

In a second variant for placing the locking pin in the latching region in braked and/or damped relationship, the transfer of kinetic energy to the locking pin is not delayed or controlled, but rather the movement of the locking pin itself—on which the full force of the ejection force storage member is already acting—is damped or braked. For that purpose, an alternative configuration provides that the damping device has a moveable damping element, preferably a rotational damper, and the damping element includes a gear which is mounted in damped rotary relationship. At least one tooth of the gear can be contacted by the locking pin in the latching engagement movement region and is moveable in damped relationship in the direction of the latching region. Thus, in practice, the tooth of the gear in the latching engagement movement region forms a kind of brake so that the locking pin cannot move unimpededly into the latching region. As the locking pin is preferably arranged on a pivotable locking lever, the locking pin damping action can also be produced by the provision of a rotational damper or a friction brake in the region of the axis of rotation of the locking lever.

In accordance with a third variant for being able to place the locking pin in the latching region in braked or damped relationship, the latching region has a damping device. Thus, there is no braking or damping of the movement of the locking pin in the latching engagement movement region, but the damping device is in the form of an elastic surface of the latching region, preferably in the form of a cushioning. That provides for a reduction in noise when the locking pin encounters or comes into a condition of contact in the latching region.

In principle, preferably there are a base plate and a slider forming the ejection element, to give a structurally simple configuration, and the slider is moveable relative to the base plate and is lockable by way of the locking device to the base plate. In that case, the ejection force storage member which is preferably in the form of a tension spring is fixed on the one hand to the base plate and on the other hand to the slider. To permit the movement of the locking pin in the guide path, preferably the locking pin is mounted rotatably to the slider by way of a locking lever and engages into the guide path in the base plate. In that case, as stated, the movement of the locking lever can also be damped by way of a damping device.

In principle, the ejection force storage member can be loaded by opening and/or closing the moveable furniture part. It is also possible that the entire drive device can be unlocked or triggered by over-pressing the moveable furniture part into an over-pressing position which is behind the closed position in a closing direction and/or by pulling on the moveable furniture part into an open position in front of the closed position.

Furthermore, the essential components of the drive device can be arranged on a furniture carcass of an article of furniture, and the moveable furniture part can be ejected by an entrainment portion mounted to the moveable furniture part or the drawer rail. In a preferred embodiment of the present invention, however, the base plate of the drive device is arranged on the moveable article of furniture and an entrainment portion which can be brought into engagement with the ejection element is arranged on the furniture carcass. Thus, the moveable furniture part virtually pushes itself away against the furniture carcass by the drive device.

BRIEF DESCRIPTION OF THE DRAWINGS

Further details and advantages of the present invention will be described more fully hereinafter by means of the specific description with reference to the embodiments by way of example illustrated in the drawings, in which.

DETAILED DESCRIPTION OF THE INVENTION

Figure 1:
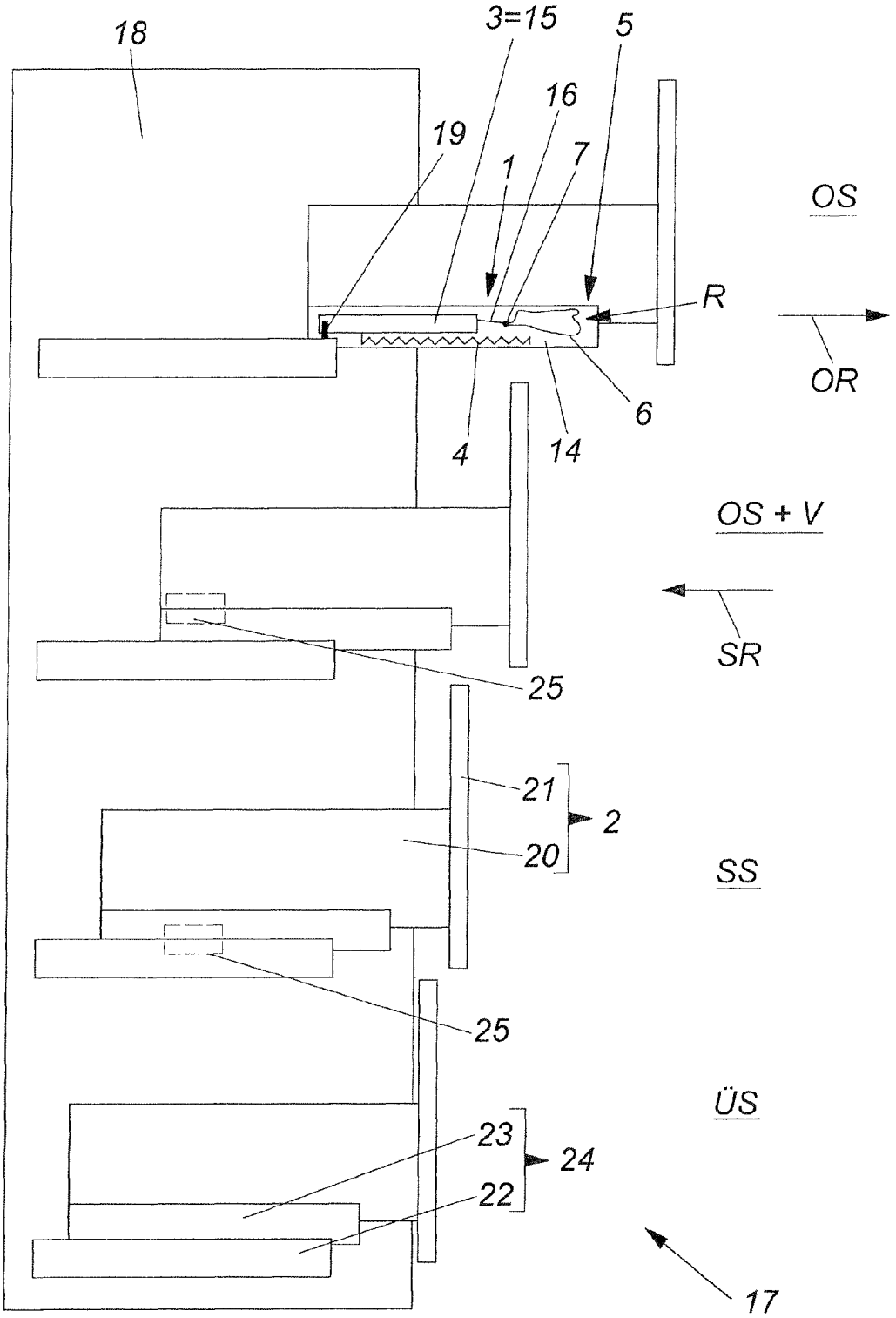
FIG. 1 shows an article of furniture with moveable furniture parts in various positions.

FIG. 1 shows an article of furniture 17 with a plurality of moveable furniture parts 2 in the form of drawers, mounted moveably to the furniture carcass 18. In this case, the individual moveable furniture parts 2 are respectively fixed to the furniture carcass 18 by an extension guide 24, the extension guide 24 including at least a carcass rail 22 and a drawer rail 23. There may possibly also be a central rail. The moveable furniture part 2 itself has at least one drawer container 20 and a front panel 21. The moveable furniture part 2 shown right at the top is in an open position OS and it can be diagrammatically seen that the drive device 1 is mounted to the drawer container 20 or the drawer rail 23. As essential components, the drive device 1 has a base plate 14 and an ejection element 3 moveable relative to the base plate 14. That ejection element 3 is in the form of a displaceable slider and is acted upon by an ejection force storage member 4. The ejection element 3 is engaged via an entrainment portion 19 with the carcass rail 22 and with the furniture carcass 18, respectively. Upon ejection, the drive device 1 bears against the entrainment portion 19 via the ejection element 3 and the ejection force storage member 4 which in this case is in the form of a compression spring and moves the moveable furniture part 2 in the opening direction OR. That ejection element 3 is lockable to the base plate 14 by way of a locking device 5. For that purpose, the locking device 5 has a locking lever 16 mounted pivotably to the slider 15, the locking pin 7 disposed at the front end of the locking lever 16, and the guide path 6 in the base plate 14 having the latching region R with a latching recess. When the moveable furniture part 2 is moved from the position shown by the uppermost drawer into the position therebeneath, then in that movement in the closing direction SR the slider 15 is moved towards the right relative to the base plate 14, with the ejection force storage member 4 being stressed. As soon as the locking pin 7 passes into the latching recess of the latching region R of the guide path 6, the locking position V of the locking device 5 is reached. That can already be the case when the moveable furniture part 2 is still open, in particular when the moveable furniture part 2 is moved from the second illustrated position into the third illustrated position by a retraction device 25 (only diagrammatically indicated here) into the closed position SS. The lowermost illustration in FIG. 1 shows the triggering position or over-pressing position ÜS, in which a pressure is applied to the moveable furniture part 2 in the closing direction SR to thereby unlock the locking device 5. It is, however, also possible to provide for unlocking by pulling.

Figure 2:
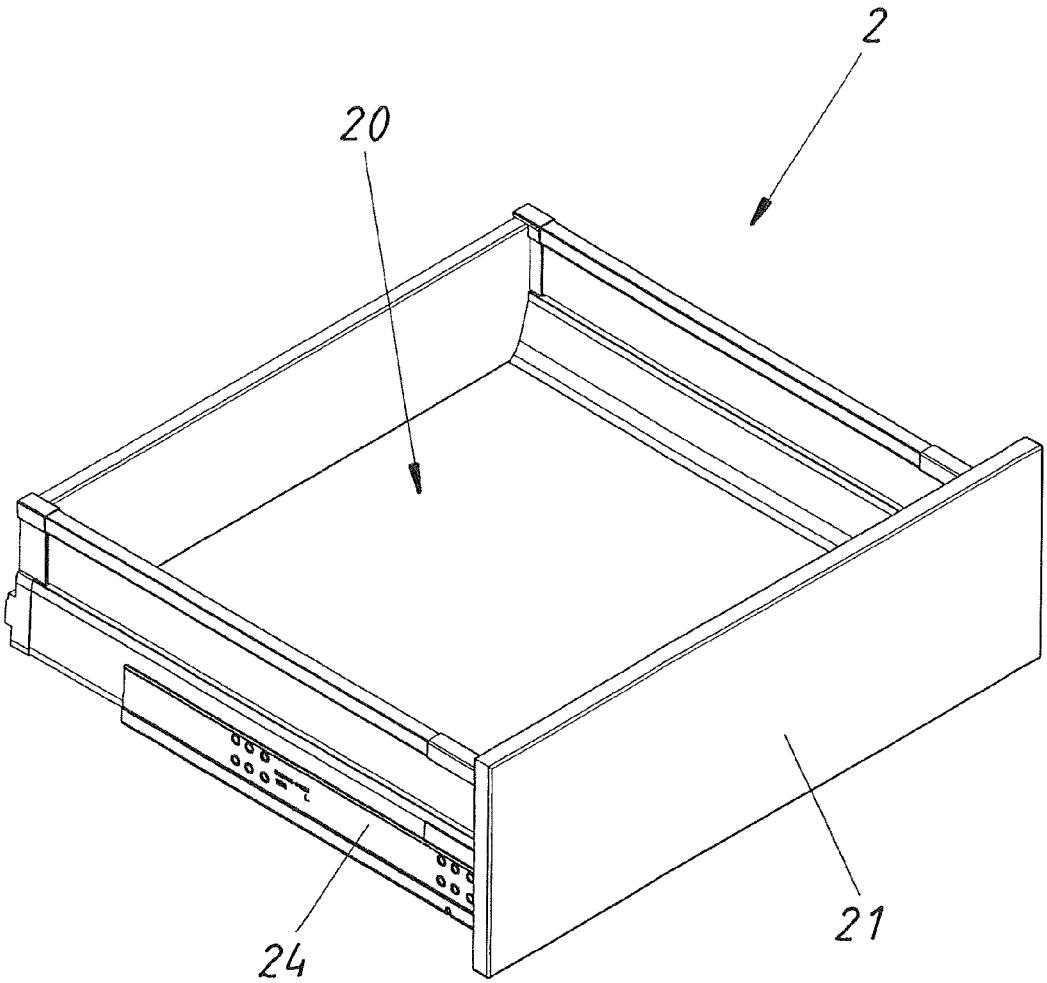
FIG. 2 is a perspective view of a moveable furniture part.

FIG. 2 is a perspective view of the moveable furniture part 2, in which respect it can be seen that the moveable furniture part 2 comprises a drawer container 20 and the front panel 21. It can further be seen that the moveable furniture part 2 is connected to an extension guide 24.

Figure 3:
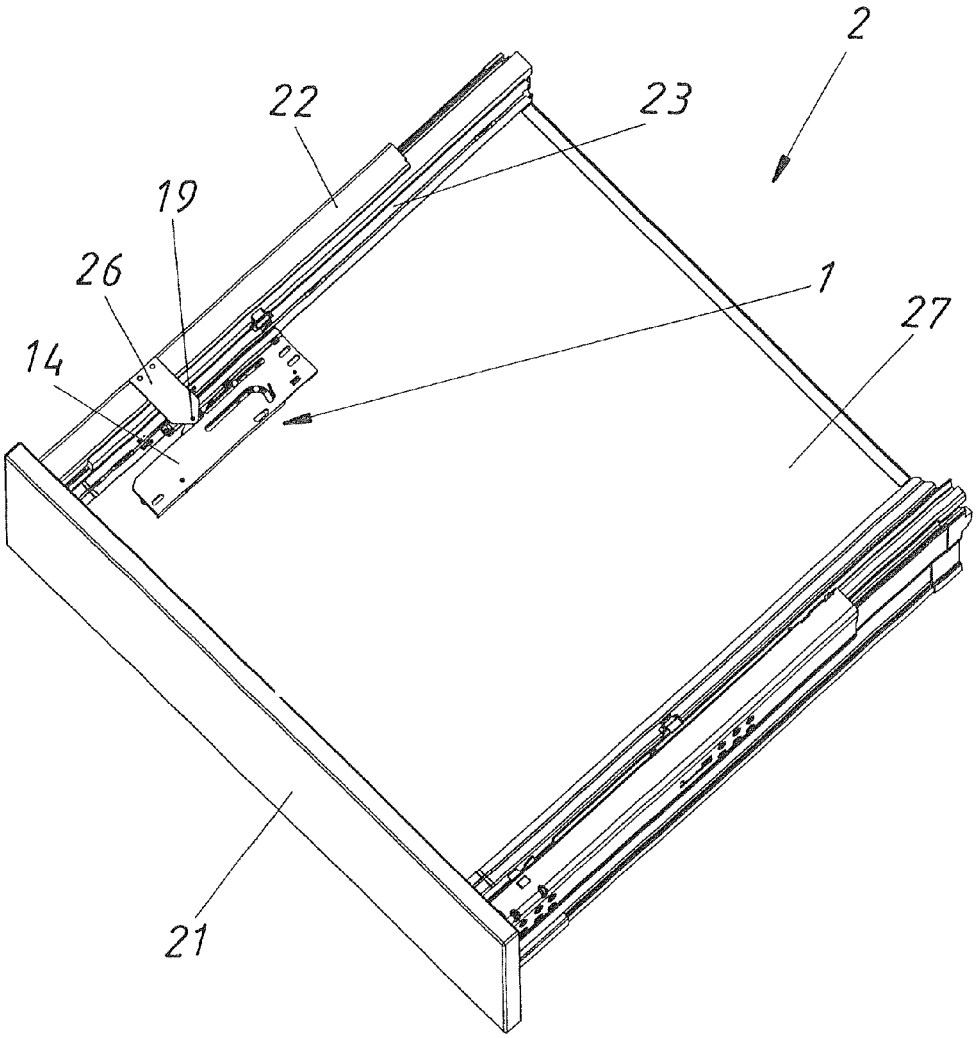
FIG. 3 shows the moveable furniture part from below with a drive device.

FIG. 3 shows the moveable furniture part 2 from below, with the drive device 1 together with the base plate 14 being mounted on the drawer bottom 27. Fixed to the carcass rail 22 is the entrainment plate 26 to which the entrainment portion 19 is mounted.

Figure 4:
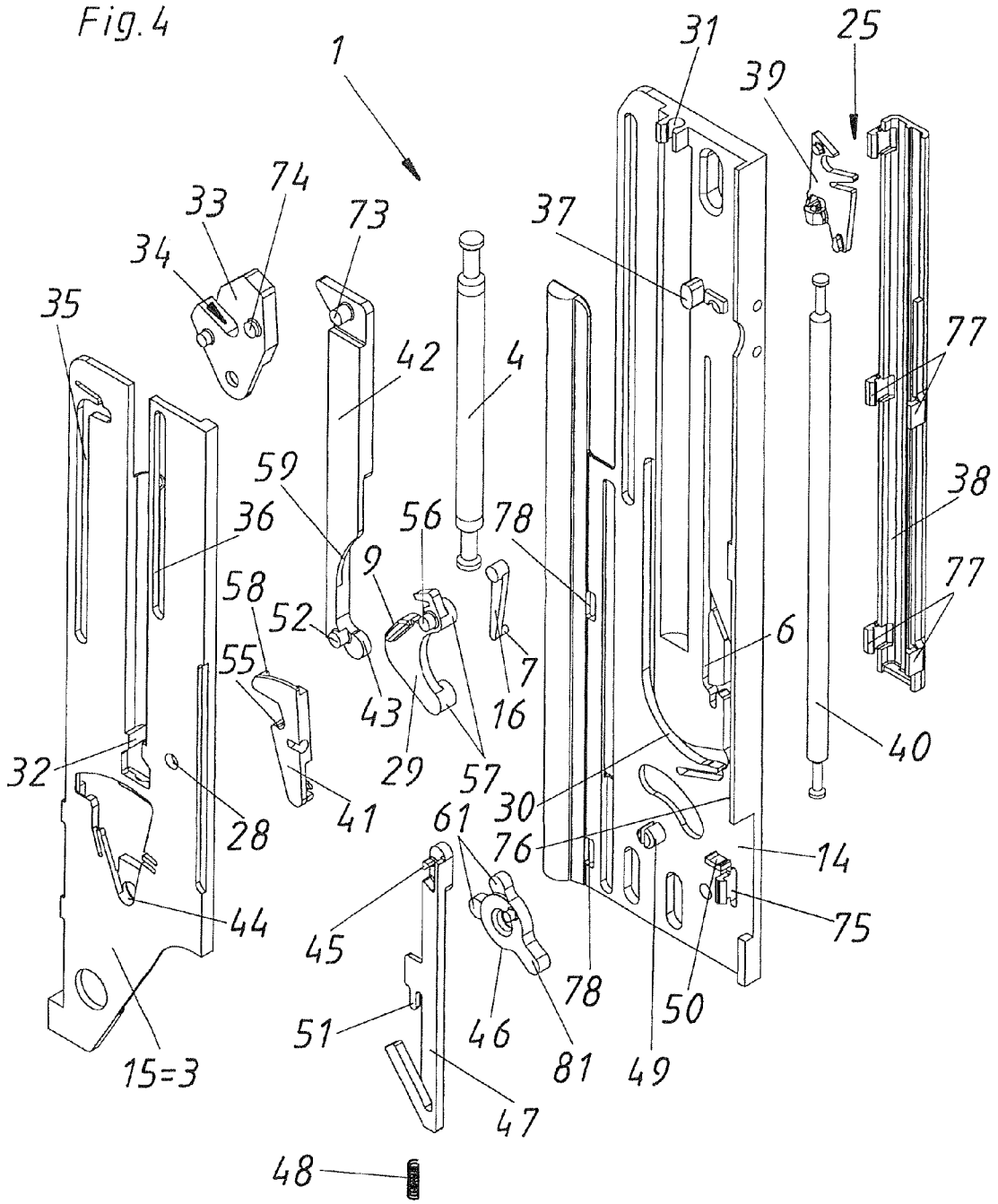
FIG. 4 is an exploded view of the drive device.

FIG. 4 is an exploded view of the drive device 1, wherein the two main components are the base plate 14 and the slider 15 forming the ejection element 3. The linear movement of those two components 14 and 15 relative to each other is limited at least by the slider path limiter 37 mounted to the base plate 14 and the slider path 36 in the slider 15. A further important component is the ejection force storage member 4 which is held at the spring base 31 on the base plate 14 and the spring base 32 on the slider 15. That ejection force storage member 4 is in the form of a tension spring. The locking lever 16 with locking pin 7 and the cardioid-shaped guide path 6 are provided as the locking device 5.

The locking lever 16 is mounted rotatably or pivotably at the rotary bearing 28 in the slider 15. In the mounted condition, the locking pin 7 engages into the guide path 6. There is further provided a transmission element 42 which is limitedly moveably mounted via a guide limiting member 52 to a path (not shown) provided at the underside of the slider 15. The coupling element 33 is pivotably mounted to that transmission element 42 at the pivot bearing 73. That coupling element 33 has the catch region 34 for the entrainment portion 19 (not shown). The pivotal movement of the coupling element 33 is controlled by the guide element 74 as the guide element 74 is guided in the coupling element guide path 35 in the slider 15. There is also a connecting element 41 mounted rotatably in the rotary bearing 44. A stressing abutment 55 is provided on that connecting element 41.

A control element 29 is moveable or displaceable by the guide elements 57 in the control element guide path 30 in the base plate 14. Also mounted to the control element 29 is the stressing element 56 which, upon stressing of the ejection force storage member 4, bears against the stressing abutment 55 of the connecting element 41. The control element 29 also has the control cam 9, against which the abutment 43 on the transmission element 42 bears depending on the respective position. Those two components 43 and 9 together form a travel transmission mechanism and thereby the damping device 8 for moving the locking pin 7 into the latching region R in damped relationship (this will be described in greater detail in the following Figures).

In addition, a first pulling triggering element 46 is mounted rotatably to the base plate 14 by way of the rotary bearing 19. That first pulling triggering element 46 has two limiting elements 61, between which the abutment 43 of the transmission element 42 is positioned in the closed position SS. There is also a second pulling triggering element 47 on which is provided the locking abutment 45 which also forms the latching region R. That locking abutment 45 thus forms a part of the guide path 6 and is moveable relative to the base plate 14. The displacement of that second pulling triggering element 47 is limited by the guide abutment 75 and the side surface 76 of the base plate 14. In addition, that second pulling triggering element 46 is pressured by the compression spring 48, wherein that compression spring 48 is fixed or held on the one hand at the spring base 50 and on the other hand at the spring base 51 on the second pulling triggering element 47.

Lastly, the drive device 1 also has a retraction device 25 which as essential components has a retraction force storage member 40, a retraction coupling element 39, and a cover element 38, wherein the cover element 38 is held by way of the holding clips 77 to the openings 78 in the base plate 14. The retraction force storage member 40 is in the form of a tension spring.

Figure 5:
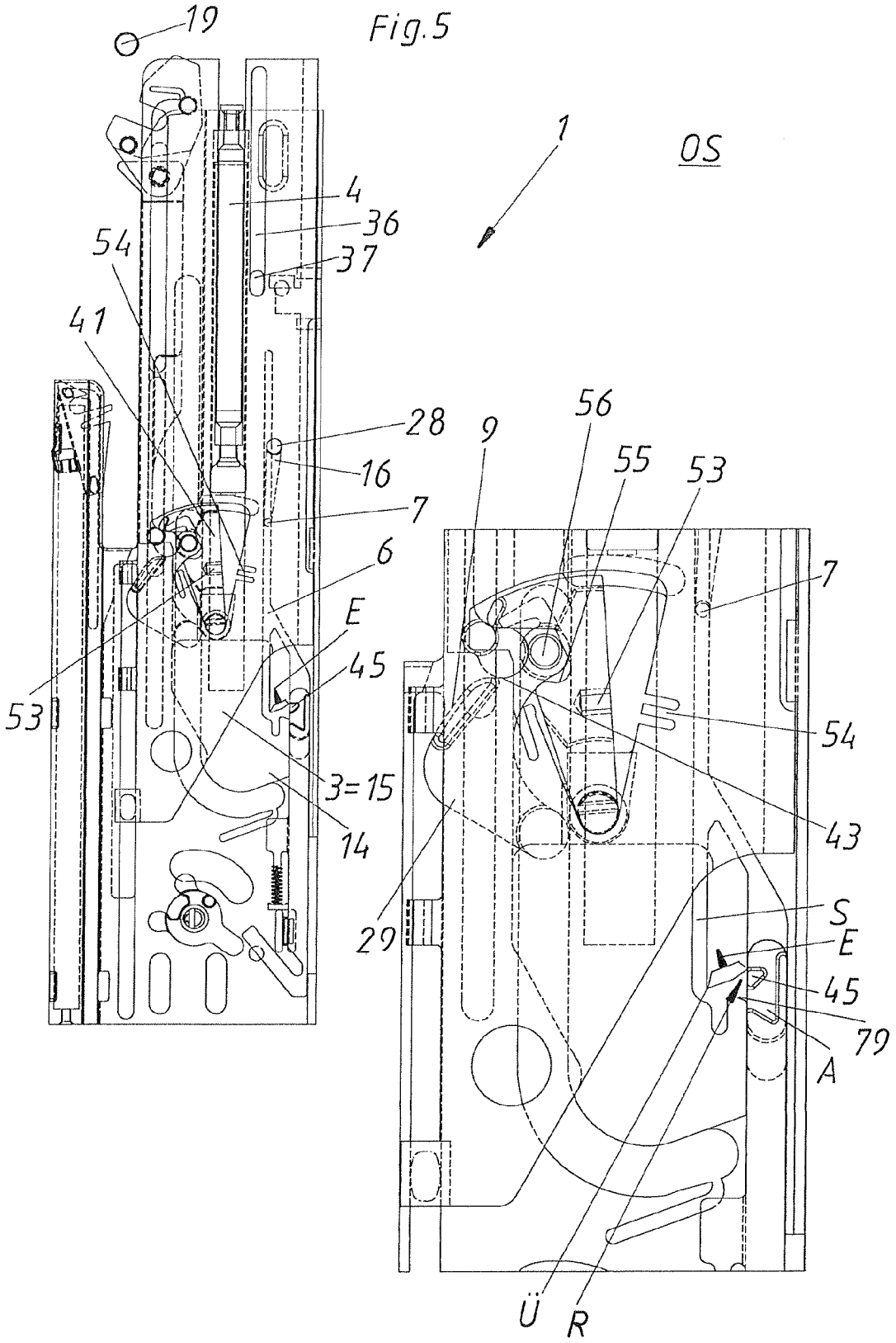
FIGS. 5 through 18 show the drive device in various positions.

Referring to FIG. 5, the entire moveable furniture part 2 is in an open position OS, with the moveable furniture part 2 still being in the free-running condition. In other words, there is still no contact with the diagrammatically illustrated entrainment portion 19. The ejection force storage member 4 is still relieved of stress, but pulls on the slider 15 until the end of the slider path 36 bears against the slider path limiter 37. The locking pin 7 is guided in a stressing portion S of the guide path 6. The stressing element 56 of the control element 29 still does not bear against the stressing abutment 55 of the connecting element 41. In contrast, the abutment 43 of the transmission element 42 already bears against the control element 29 and there at the beginning of the control cam 9. By virtue of the compression spring (not shown) operative between the spring base 53 and the spring base 54 the connecting element 41 is pivoted towards the left about the rotary bearing 44. It can further be seen in the detailed view at bottom right that the guide path 6 has the latching engagement movement region E after the stressing portion S and the transitional region Ü. The latching region R formed by the locking abutment 45 mounted to the second pulling triggering element 47 is disposed at the end of that latching engagement movement region E. That latching region R is followed by the ejection portion A, wherein the locking pin 7 passes into that ejection portion A via the diversion surface 79. It is only upon unlocking by over-pressing that the locking pin 7 meets that diversion surface 79. In contrast, upon unlocking by pulling, the locking abutment 45 is pulled away downwardly so that the path for the locking pin 7 into the ejection portion A is also free and the ejection force storage member 4 can be relieved of stress. FIGS. 6 through 18 which are described hereinafter do not always show all reference numbers. Naturally, however, the reference numbers always correspondingly apply for each of FIGS. 5 through 18.

Figure 6:
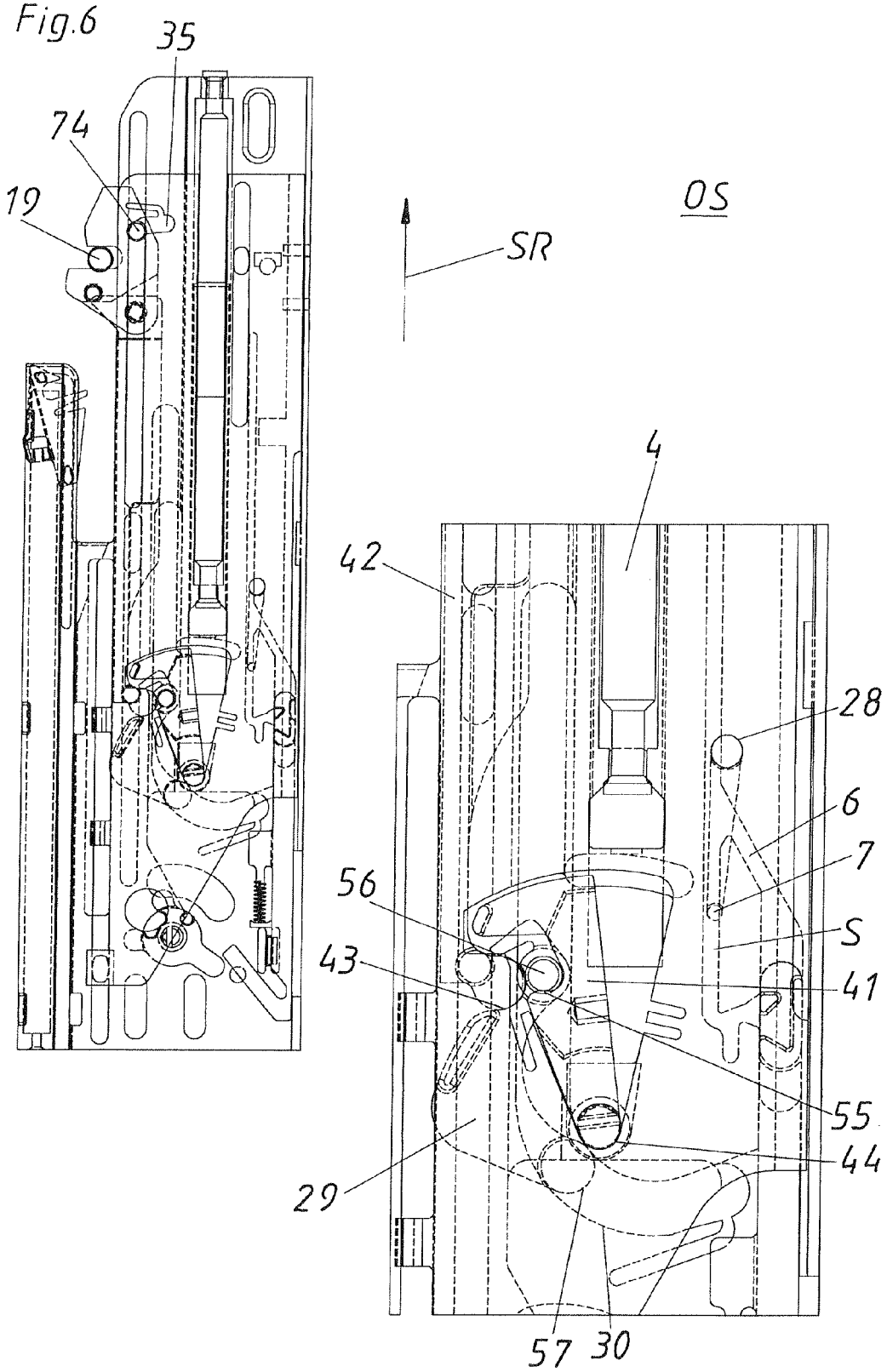

If now as shown in FIG. 6 the moveable furniture part 2 is moved together with the drive device 1 in the closing direction SR, then the coupling element 23 comes into abutment with the entrainment portion 19 which is fixed with respect to the carcass. As a result, and by virtue of the configuration of the coupling element guide path 35 and the guide element 74 guided therein, the coupling element 33 is pivoted about the pivot axis 73 and the entrainment portion 19 is caught in the catch region 34 of the coupling element 33. The coupling element 33 has already moved together with the transmission element 42 as shown in FIG. 6 by a considerable distance relative to the FIG. 5 position, by virtue of the manual closing movement of the moveable furniture part 2 in the closing direction SR. The control element 29 is also moved by that movement, by way of the abutment 43. As once again the stressing element 56 is provided on that control element 29 the connecting element 41 is also moved by way of the stressing abutment 55. As that connecting element 41 is again mounted in the rotary bearing 44 on the slider 15 the entire slider 15 and therewith the ejection element 3 are displaced relative to the base plate 14, with stressing of the ejection force storage member 4. By virtue of that displacement, the locking pin 7 also already passes further along the stressing portion S into the proximity of the transitional region Ü. It can also already be seen from FIG. 6 that the control element 29 pivots slightly by way of the guide element 57 and the control element guide path 30.

Figure 7:
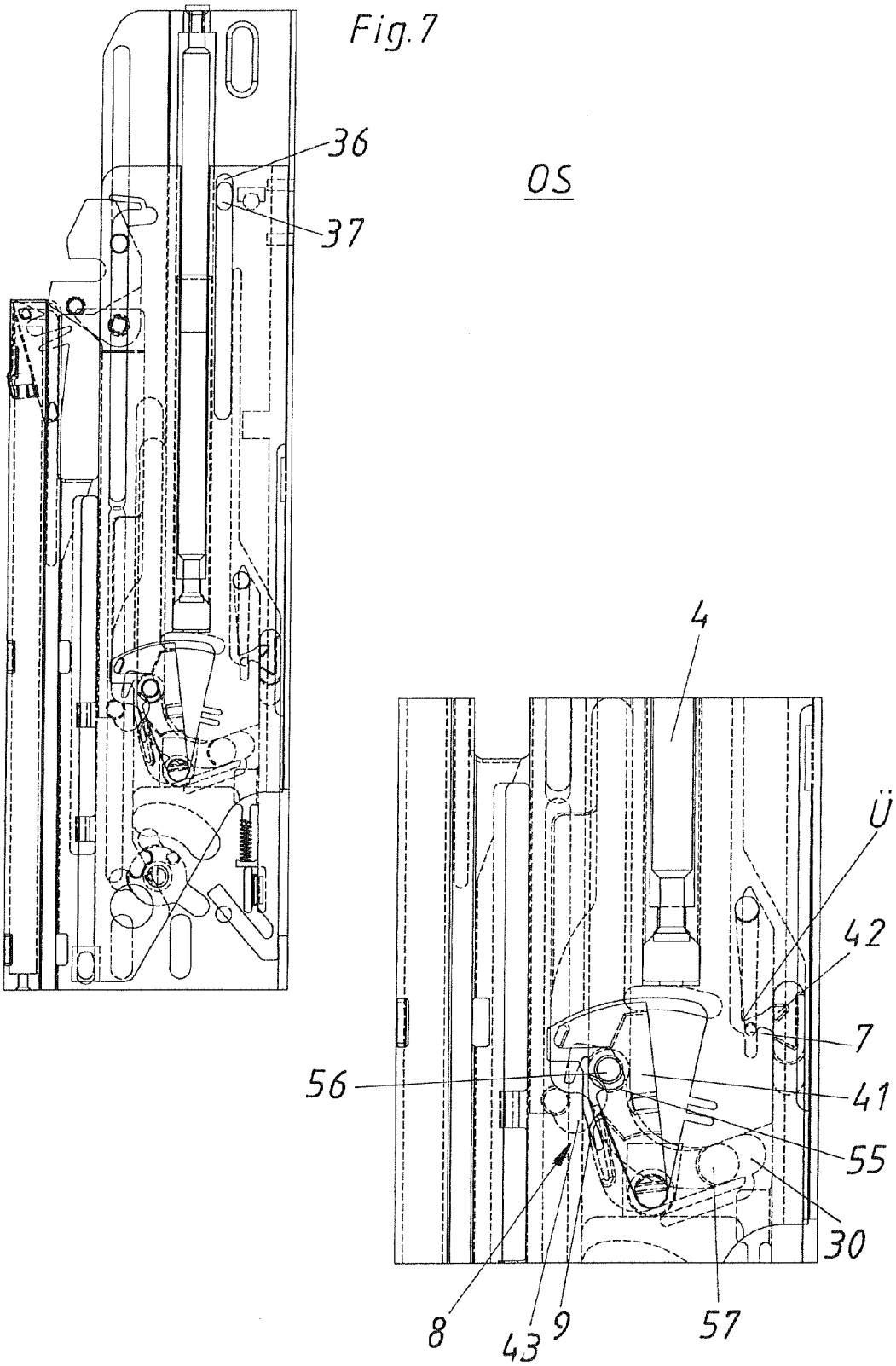

Referring to FIG. 7, the pivotal movement of the control element 29 has already further continued, whereby the abutment 43 of the transmission element 42 has already moved along the control cam 9 on the control element 29. At the same time, the locking pin 7 has also already moved beyond the transitional region Ü and is at the beginning of the latching engagement movement region E. In previous embodiments, at that moment the ejection element 3 and the slider 15 were uncoupled from the pressing movement of an operator and the slider 15 was free. As a result, the full ejection force of the ejection force storage member 4 could act on the locking pin 7 and move the locking pin 7 quickly and with a large amount of force along the latching engagement movement region E into the latching region R. As a result, in previous embodiments, there was a disadvantage of a large amount of noise being produced and a severe loading on the parts of the locking device 5. In comparison, it will be seen from FIG. 7 that the slider 15 was admittedly already slightly decoupled from the transmission element 42 and its abutment 43 by way of the ejection force storage member 4, but entire decoupling has not yet occurred by virtue of the configuration of the control cam 9. Rather, the abutment 43 and the control cam 9 form a travel transmission mechanism and thereby a kind of damping device 8 for the locking pin 7. As a result the kinetic energy operative from the ejection force storage member 4 on the locking pin 7 increases only slowly.

Figure 8:
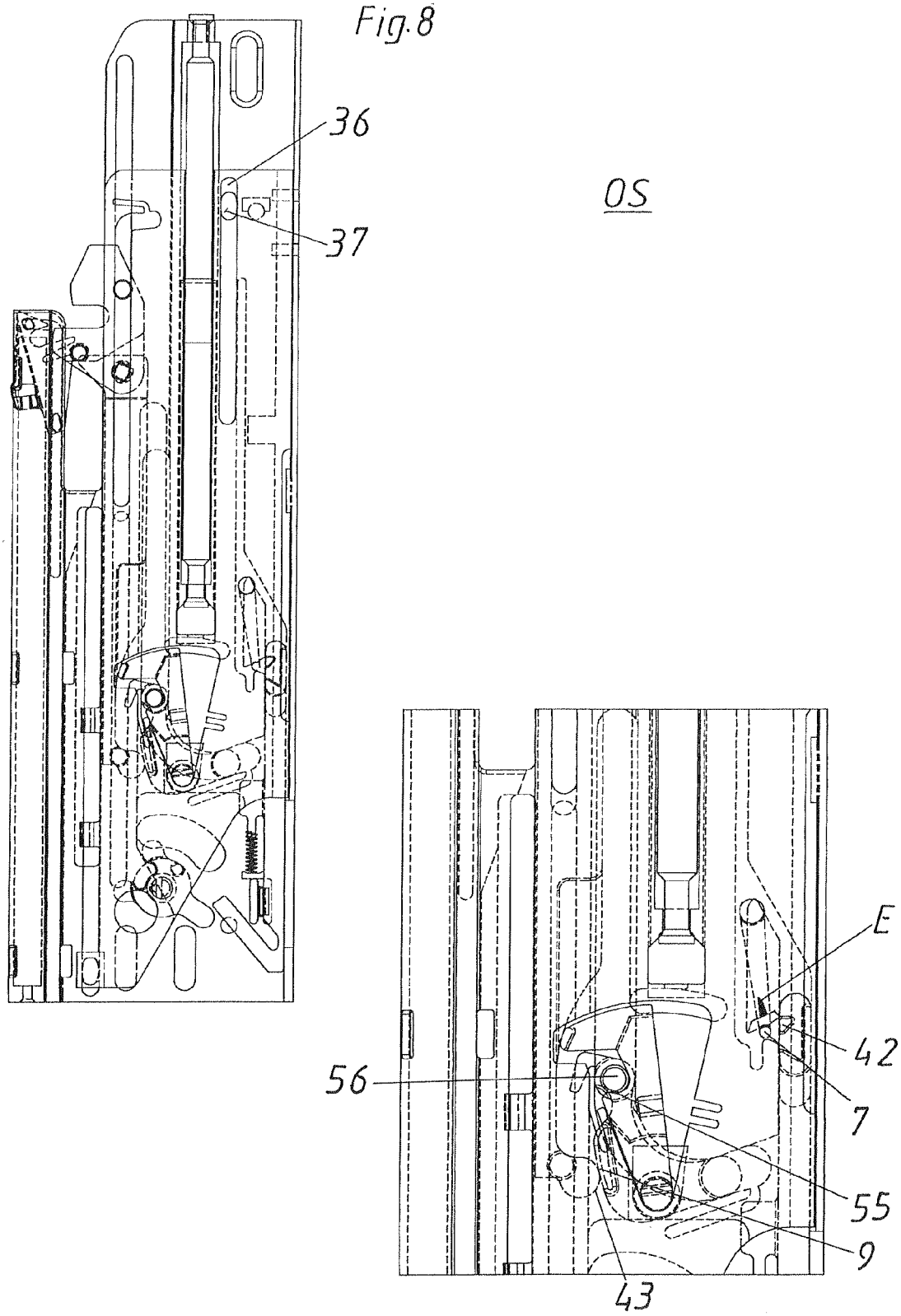

This can also be seen from FIG. 8 in which the abutment 43 has again moved further along the control cam 9 and at the same time there has been a further movement of the locking pin 7 in the latching engagement movement region E. The fact that the ejection force storage member 4 has already moved the slider 15 again relative to the base plate 14 can also be seen from the fact that the slider path limiter 37 has moved relative to the slider path 36, in relation to FIG. 7.

Figure 9:
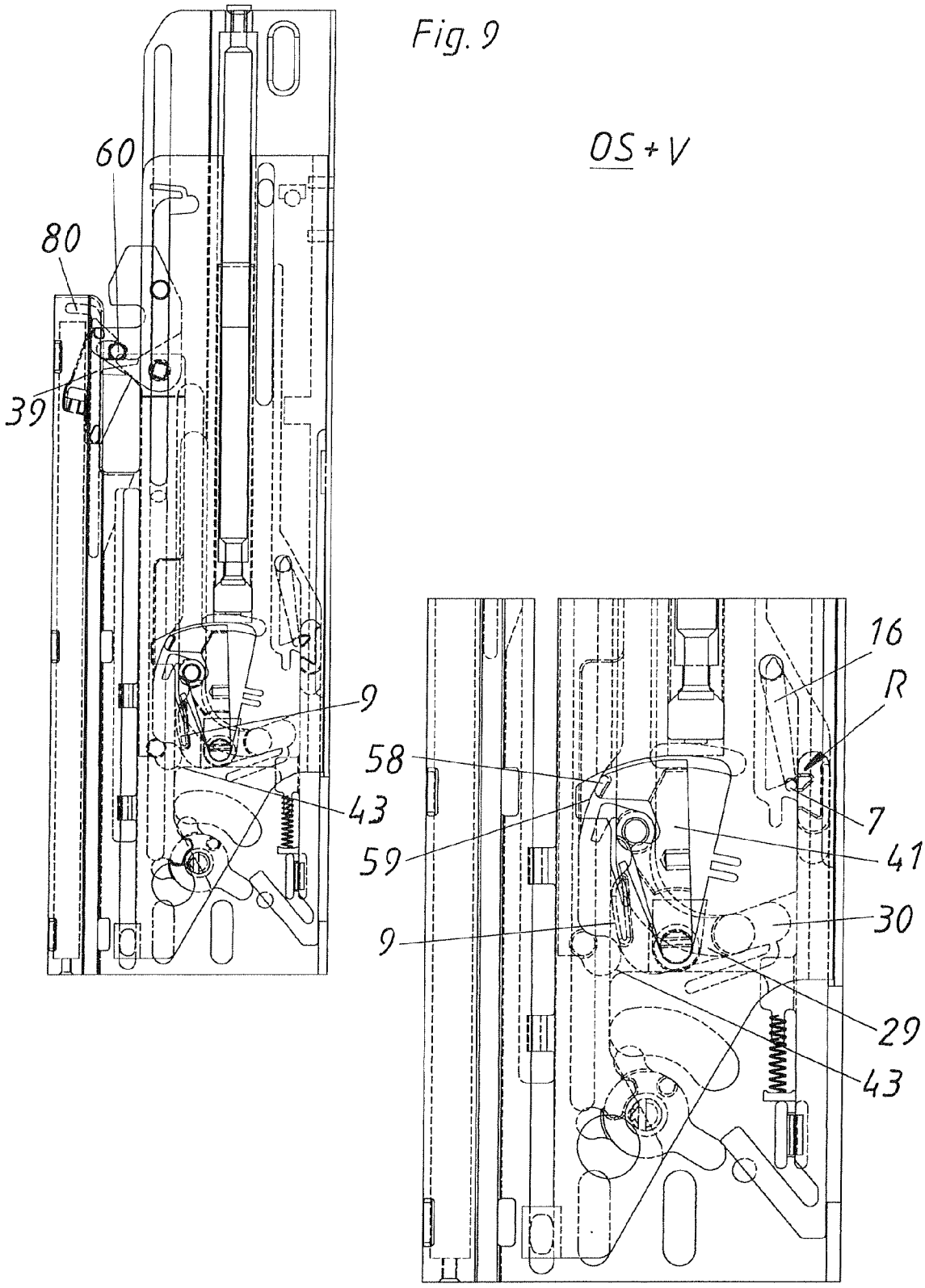
Figure 10:
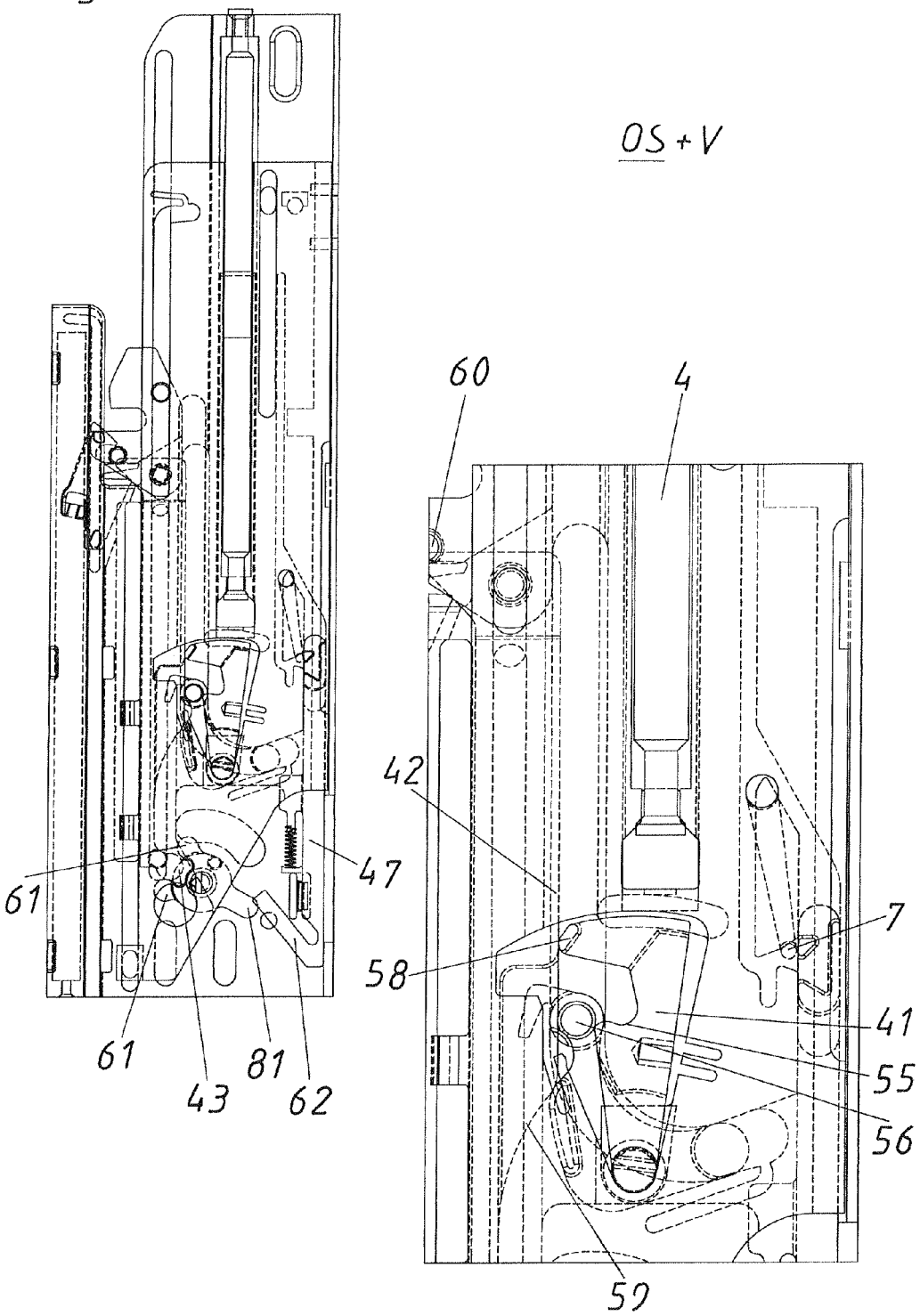

In FIG. 9 there is no longer any contact between the abutment 43 and the control cam 9 of the control element 29 whereby the full force of the ejection force storage member 4 is acting on the locking pin 7 by way of the slider 15, the rotary bearing 28 and the locking lever 16. As, at the moment of full force being exerted by the ejection force storage member 4 on the locking pin 7, that locking pin 7 however is already in the latching region R, no loud noises are produced and there is no heavy wear. In that position as shown in FIG. 9, the control element 29 is loose and is not subjected to force in the control element guide path 30. It will further be seen that, by virtue of the further movement of the transmission element 42, the connecting element 41 pivots in the clockwise direction against the force of the compression spring (not shown). That takes place as the diversion abutment 58 on the connecting element 41 is moved or diverted by the diversion surface 59 on the transmission element 42. It can further be seen from FIG. 9 that the locking device 5 is admittedly already in the locking position V, but the moveable furniture part 2 is still in an open position OS. By virtue of the manual closing movement, however, the coupling element 33 has already moved relative to the base plate 14 to such an extent that the retraction coupling element 39 has moved out of the angled end portion 80 of the retraction device 25 so that the retraction coupling element 39 is coupled to the coupling pin 60 on the coupling element 33. Because the retraction coupling element 39 is now no longer in the angled end portion 80, the retraction force storage member 40 can also be relieved of stress, contracting as it does so, so that the entire moveable furniture part 2 is further moved in the closing direction SR and reaches the position shown in FIG. 10. That position corresponds to a position shortly before reaching the closed position SS. It will also be seen from this FIG. 10 that, by virtue of the further movement of the transmission element 42 relative to the slider 15, the connecting element 41 has been further pivoted in the clockwise direction by way of the diversion abutment 58. As a result, the stressing element 56 of the control element 29 comes out of engagement with the stressing abutment 55 of the connecting element 41. FIG. 10 further shows that the abutment 43 of the transmission element 42 is now between the limiting elements 61 of the first pulling triggering element 46, wherein the arm 81 of the first pulling triggering element 46 bears laterally against the elastic arm 62 of the second pulling triggering element 47.

Figure 11:
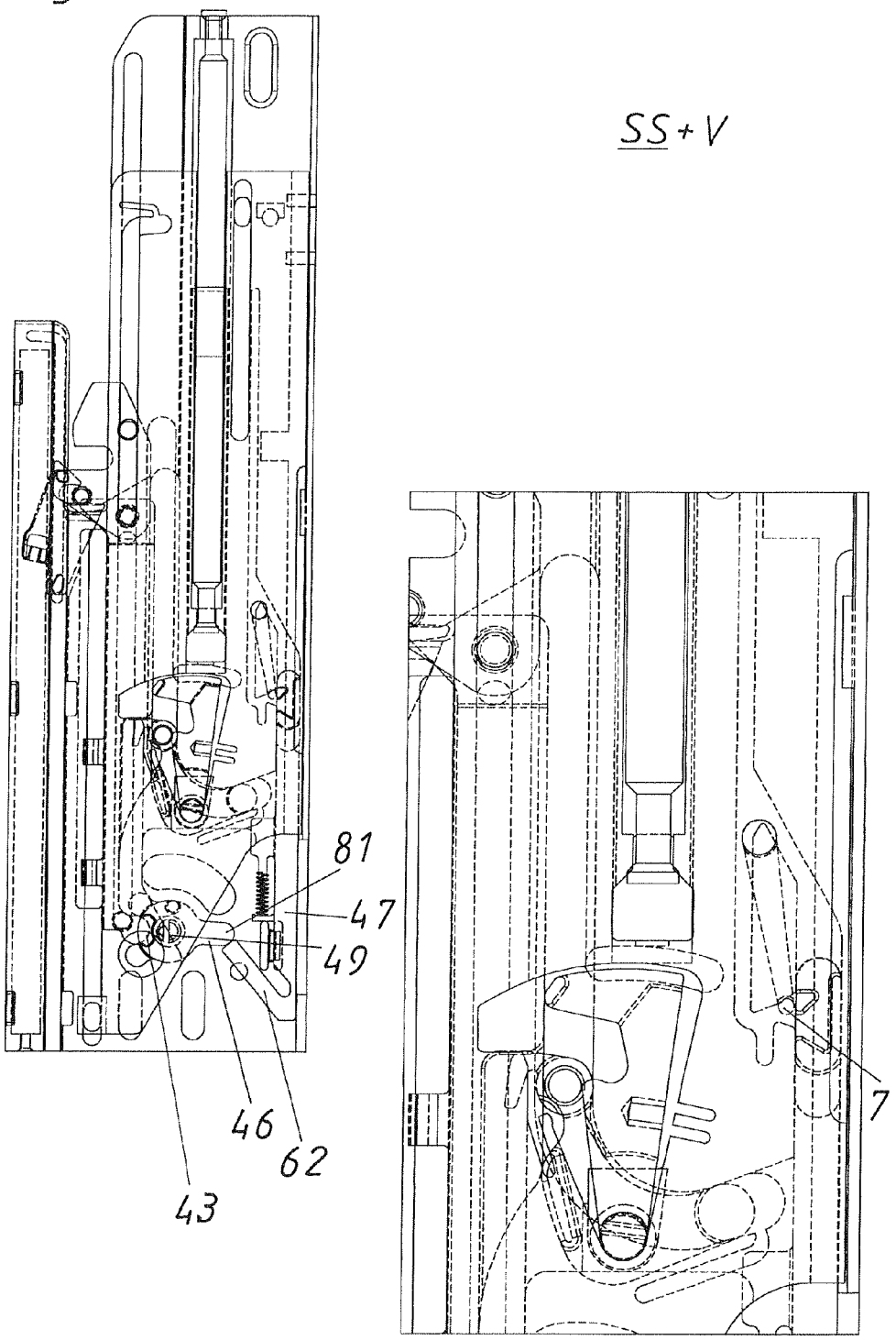

When now the retraction force storage member 40 is relieved of stress as shown in FIG. 11, the closed position SS as shown in FIG. 11 is reached. As shown in FIG. 11 the first pulling triggering element 46 has also rotated about the rotary bearing 49 in the counter-clockwise direction by virtue of the pressure exerted by way of the abutment 43 and the transmission element 42, wherein the arm 81 now bears against the front side of that elastic arm 62, with flexing of the elastic arm 62.

Figure 12:
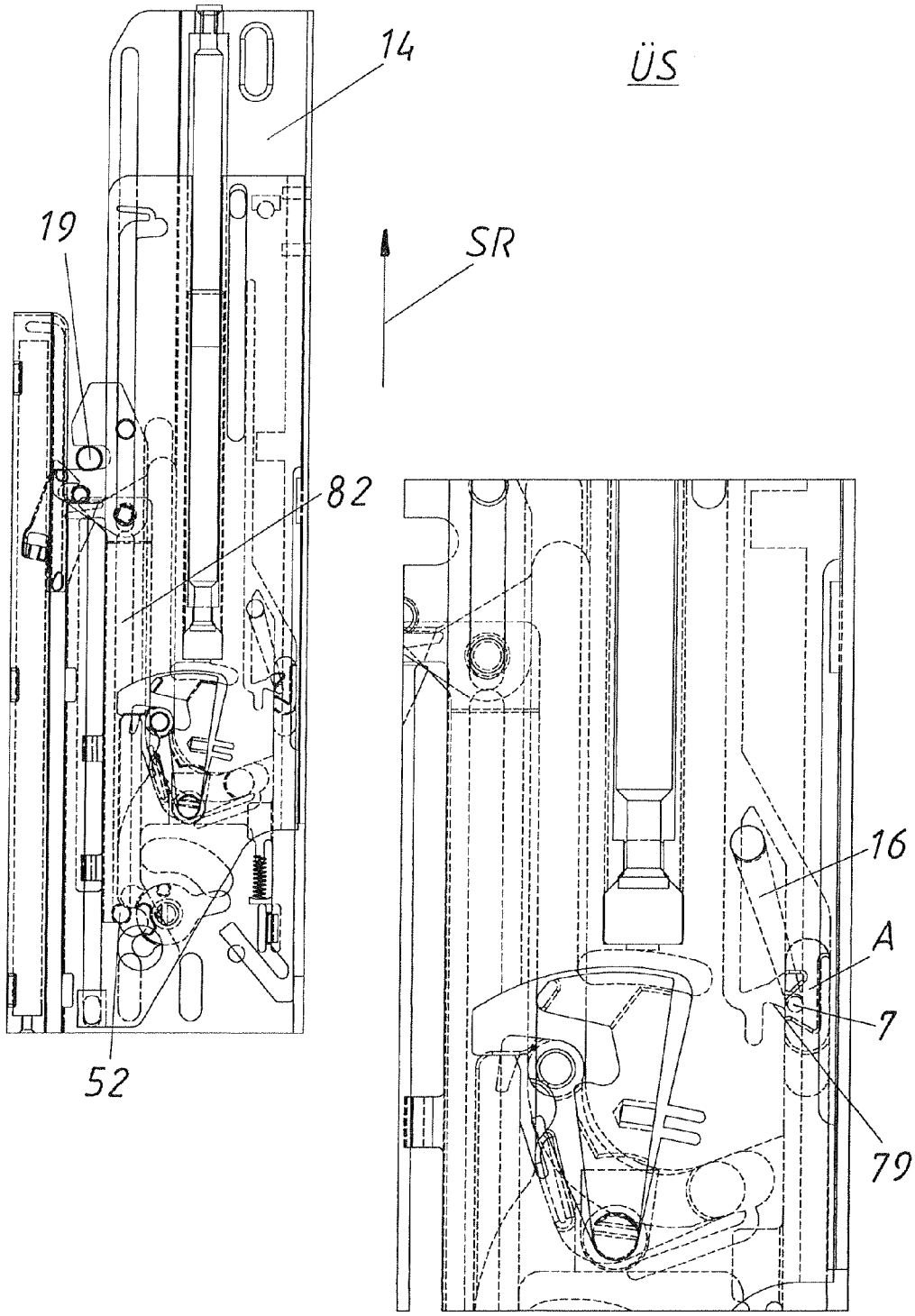

If now a pressing force is applied to the moveable furniture part 2 in the closing direction SR starting from that closed position SS as shown in FIG. 11, then the moveable furniture part passes into the over-pressing position ÜS as shown in FIG. 12. As the transmission element 42 has already reached the end of the path in the slider 15 by way of the guide limiting member 52 as shown in FIG. 11, then in the over-pressing situation the entire slider 15 is moved relative to the base plate 14, whereby the locking pin 7 also passes out of the latching region R into the ejection portion A by way of the diversion surface 79.

Figure 13:
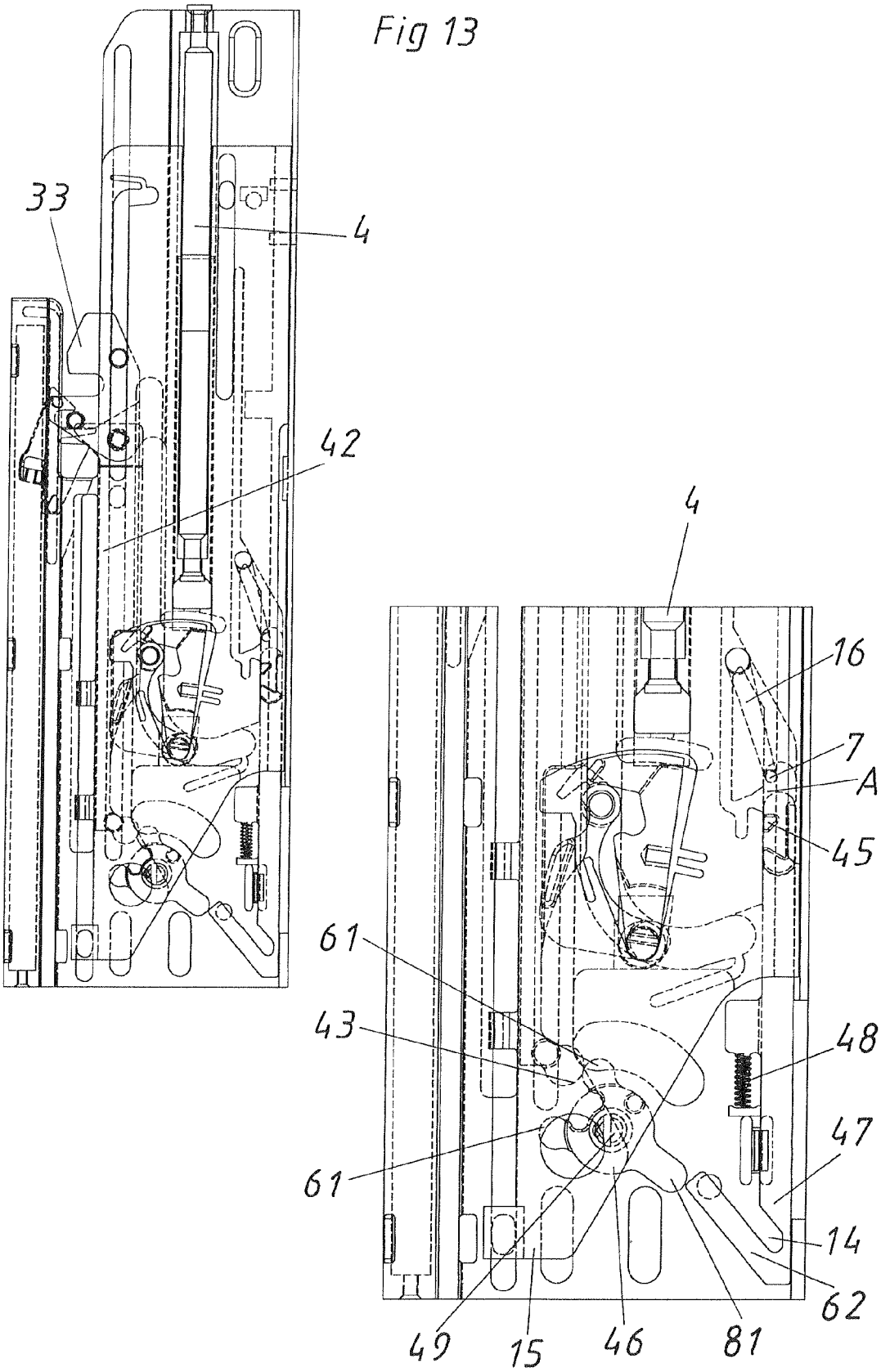

As an alternative thereto, as shown in FIG. 13, unlocking can also be effected by pulling. In that case, starting from the position shown in FIG. 11, the moveable furniture part 2 is pulled, in which case the transmission element 42 and its abutment 43 are moved relative to the slider 15 by way of the coupling element 33. As the abutment 43 as shown in FIG. 11 is still caught between the limiting elements 61, the first pulling triggering element 46 is rotated in the clockwise direction about the rotary bearing 49 by that pulling movement. As the arm 81 of that first pulling triggering element 46 bears against the end of the elastic arm 62—which, when it is acted upon with force by that end does not elastically yield but remains stiff—of the second pulling triggering element 47, that pulling triggering element 47 is moved relative to the base plate 14 against the force of the spring 48 which is compressed in FIG. 13, whereby the locking abutment 45 also moves away from the latching region R. As a result, the locking pin 7 is no longer held or locked in the latching region R and it passes into the ejection portion A by virtue of the spring force of the ejection force storage member 4.

Figure 14:
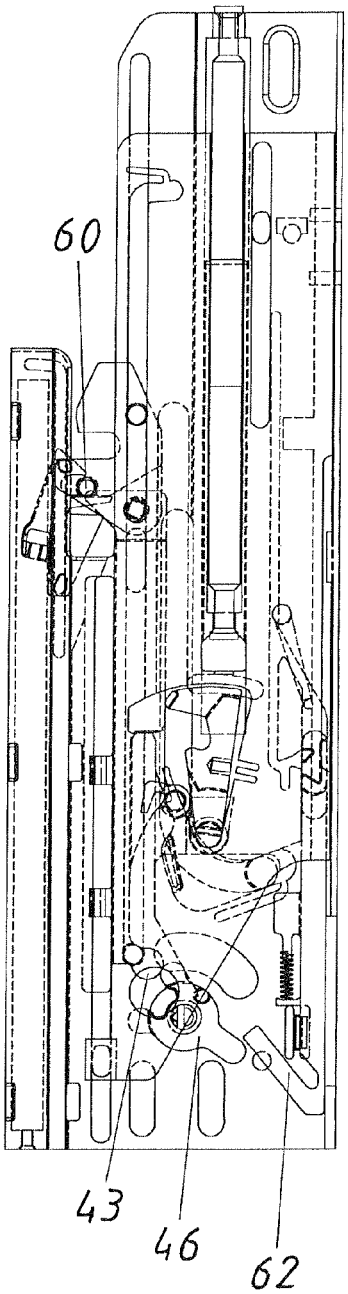
Figure 14:
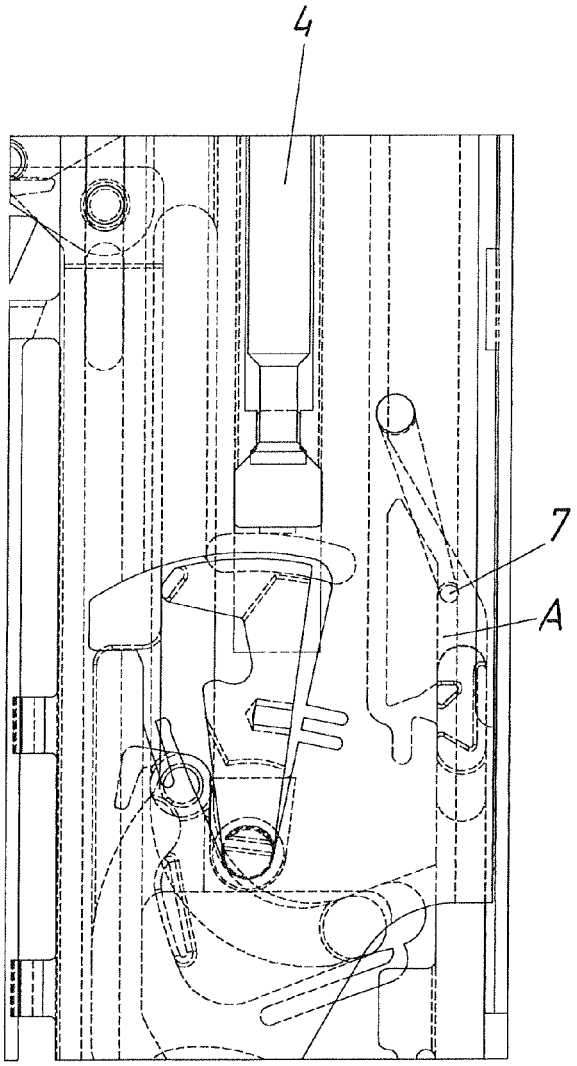
Figure 15:
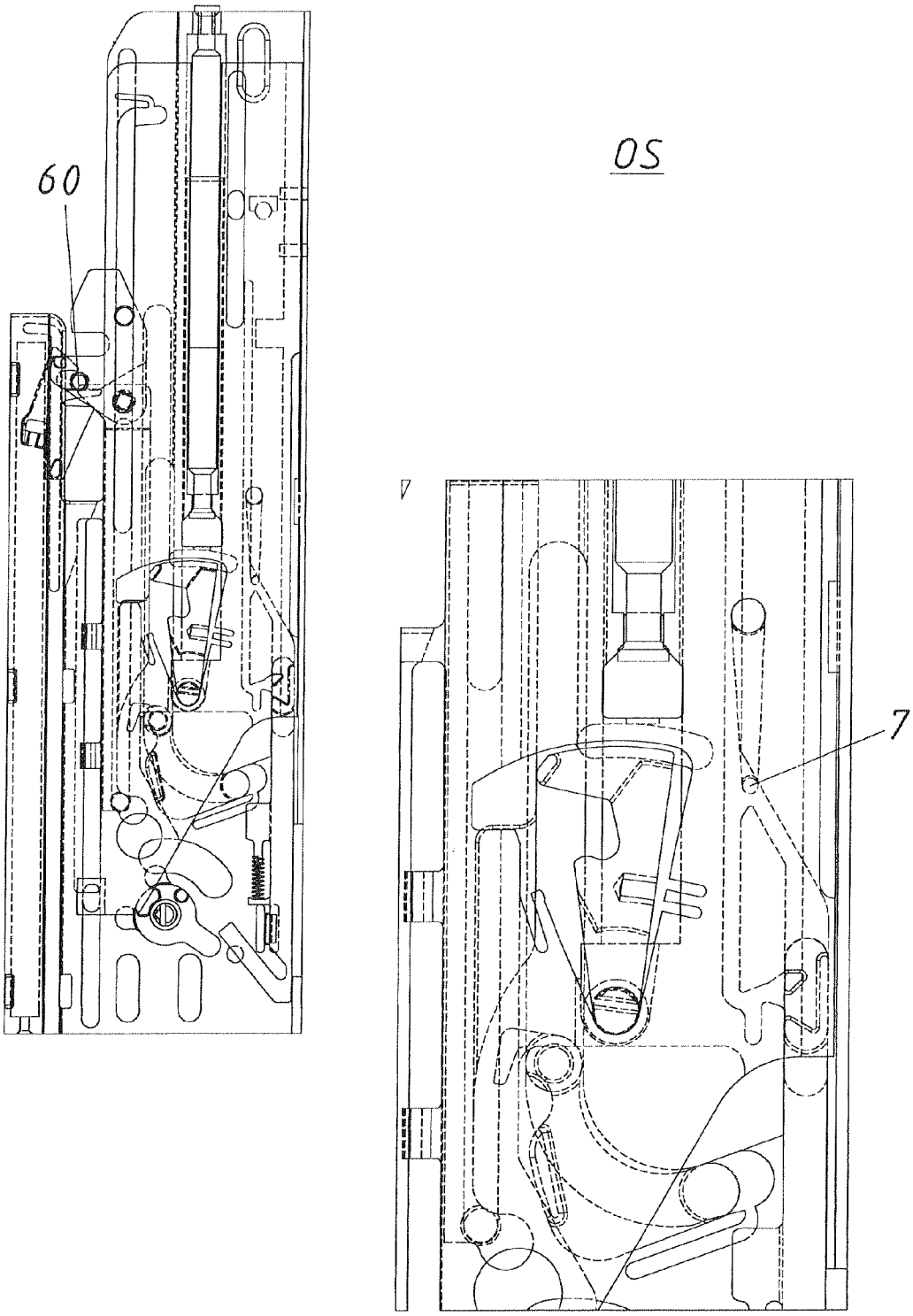

Irrespective of whether the locking device 5 was unlocked by pulling or by over-pressing, the drive device 1 then at any event passes into the open position OS as shown in FIG. 14. With that movement, the first pulling triggering element 46 is also further rotated in the clockwise direction by way of the abutment 43, whereby the second pulling triggering element 47 is moved against the force of the spring 48 until the first pulling triggering element 46 passes into the position shown in FIG. 14.

During that ejection movement, the retraction force storage member 40 of the retraction device 25 is also stressed by the coupling pin 16. The locking pin 7 passes into the stressing portion S again (see FIG. 15).

Figure 16:
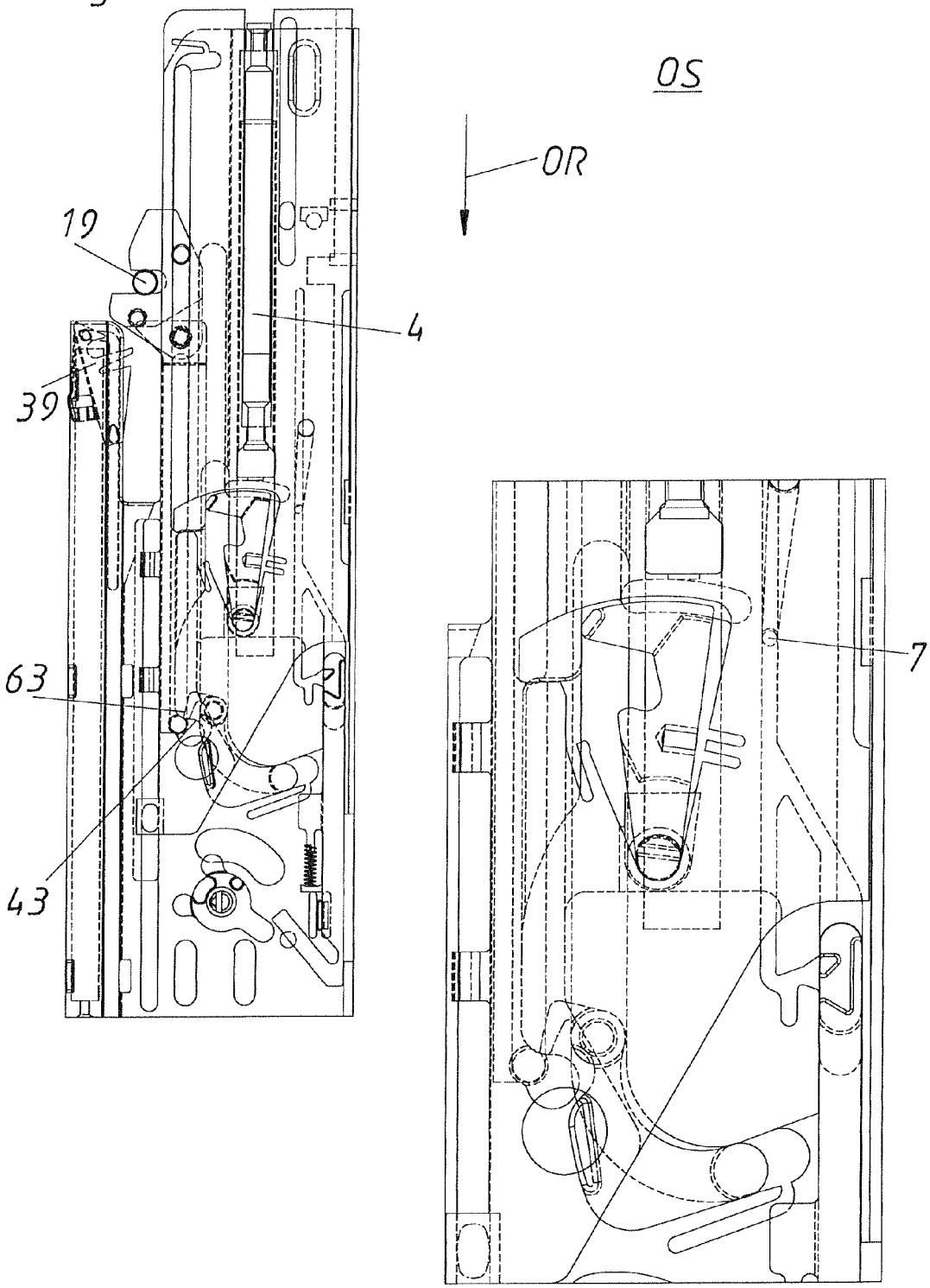

In FIG. 16, the retraction coupling element 39 is again uncoupled from the coupling pin 60 of the coupling element 33 and the retraction coupling element 39 is held in the angled end portion 80 with the retraction force storage member 40 in the stressed condition. In FIG. 16 the ejection force storage member 4 is not yet entirely relieved of stress.

Figure 17:
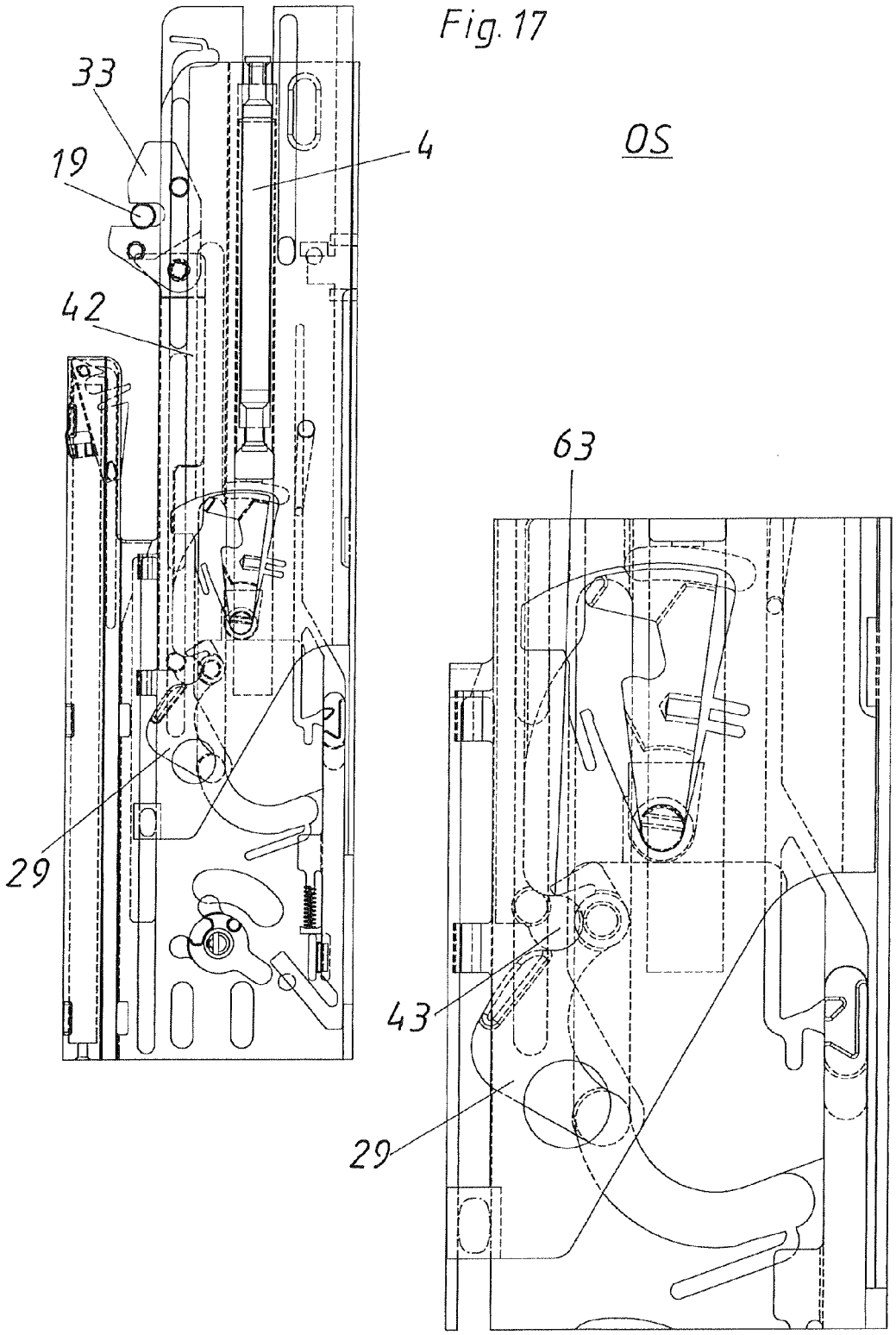

In FIG. 17, however, the ejection force storage member 4 has been relieved of stress to such an extent that now the slider 15 bears against the base plate 14 by way of the slider path 36 and the slider path limiter 37, in an end position. The moveable furniture part 2 is now freely moveable or for example can move still further in the opening direction OR due to the inertia triggered by the ejection force storage member 4. As the entrainment portion 19 is still held in the catch region 34 of the coupling element in the further movement in the opening direction OR the coupling element 33 together with the transmission element 42 is moved further relative to the slider 15, in which case the abutment 43 already comes into contact with the abutment 63 on the control element 29, as shown in FIG. 16, whereby the control element 29 is also moved along the control element guide path 30 by the transmission element 42 relative to the slider 15.

Figure 18:
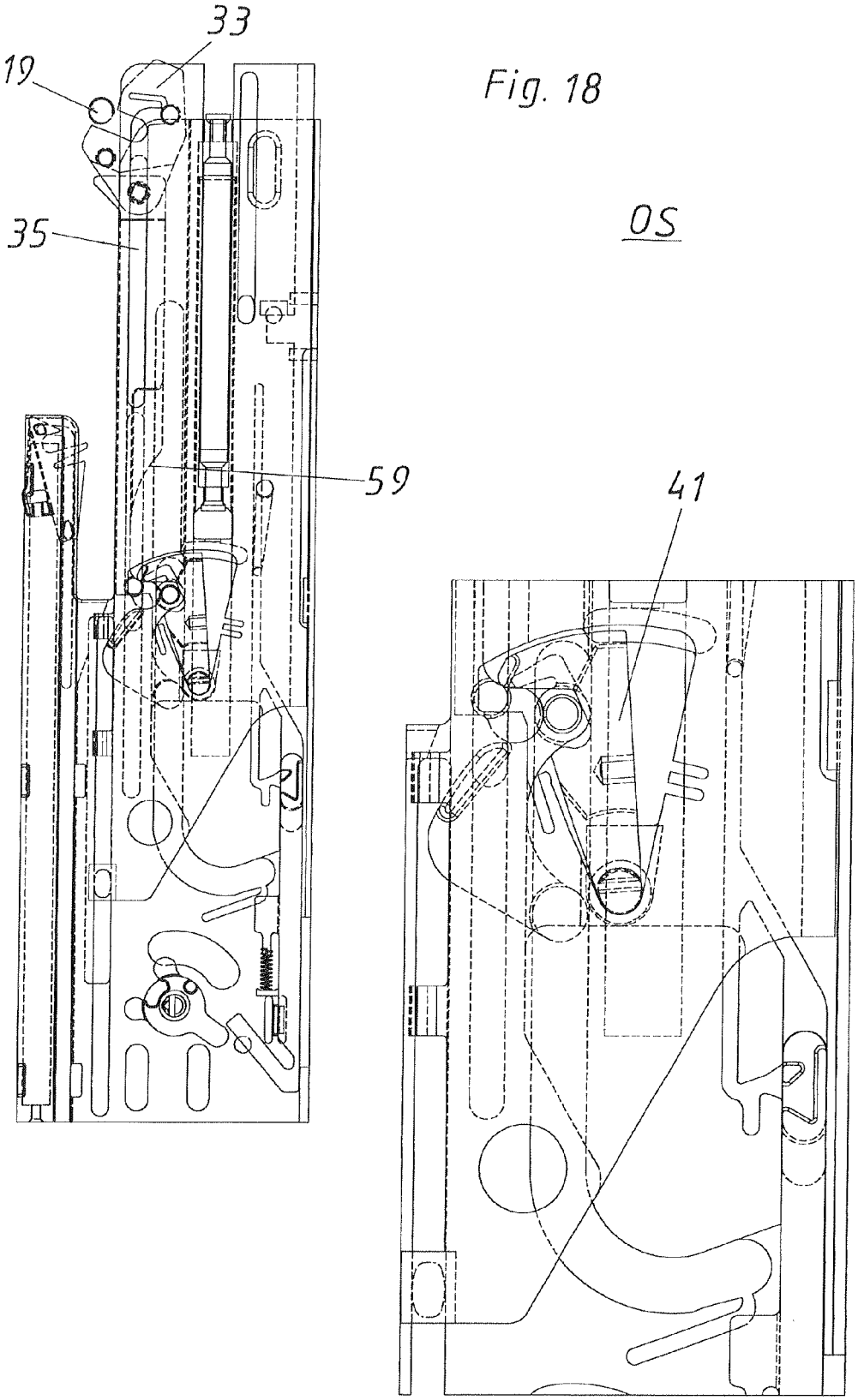

As shown in FIG. 18, the transmission element 42 has moved relative to the slider 15 until the control element 29 is again at the height of the connecting element 41. At the same time the spring (not shown) between the connecting element 41 and the slider 15 has also been relieved of stress by virtue of the diversion abutment 58 which is no longer deflected by the diversion surface 59. In FIG. 18, the coupling element 33 has also reached the angled end portion of the coupling element guide path 35 so that the coupling element 33 has been pivoted about the pivot bearing 73 so that the entrainment portion 19 is released from the catch region 34 of the coupling element 33. The initial position shown in FIG. 5 is thus restored.

Figure 32:
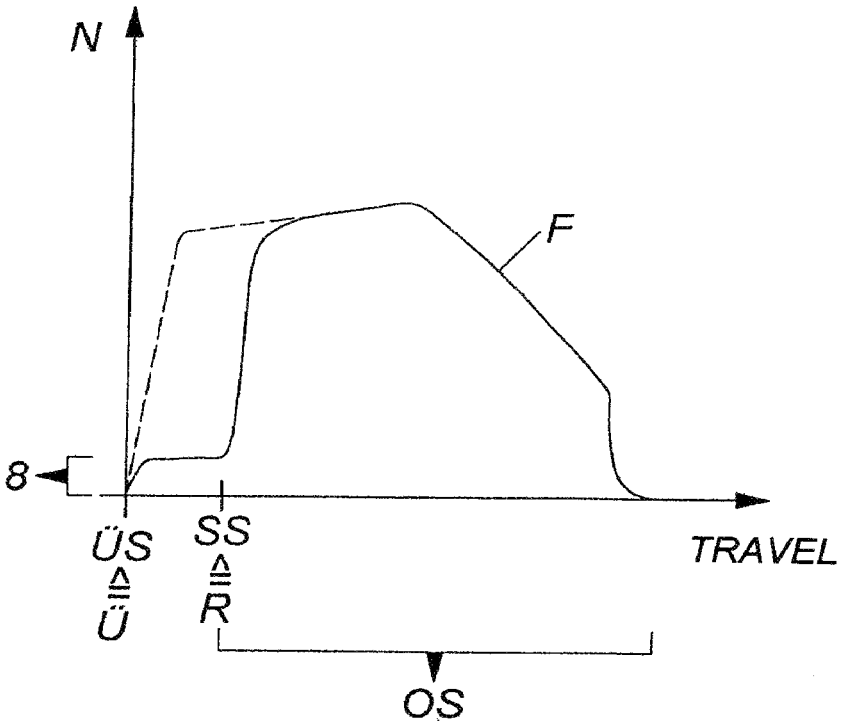
FIG. 32 is a graph illustrating the spring force of the ejection force storage means matching the first variant.
Figure 33:
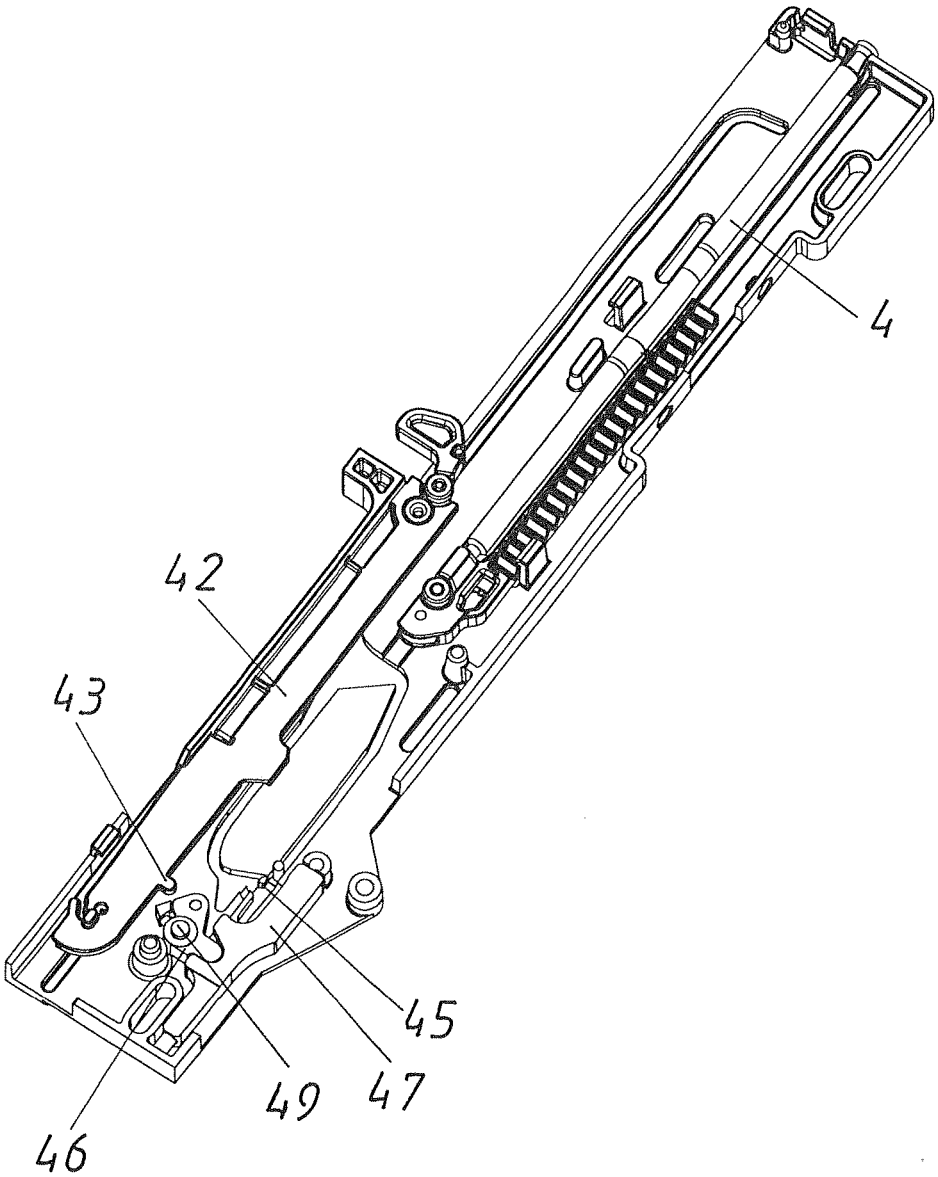
FIGS. 33 through 40 show further examples for triggering by pulling.

Another way of not immediately causing the entire force of the ejection force storage member 4 to act on the locking pin 7—as in the case of the travel transmission mechanism—provides that the ejection force storage member itself is damped. For that purpose, in particular in the first range of movement of the ejection force storage member 4, acting in the opening direction OR, going from the over-pressing position ÜS to the closed position SS, a damping device 8 can reduce the transmission of force from the ejection force storage member 4 to the slider 15. That is diagrammatically shown in FIG. 32. It will be seen from the graph in FIG. 32 how the spring force F of the ejection force storage member 4 acts along the path of movement of the moveable furniture part 2. In normal ejection illustrated by the broken line, when the moveable furniture part 2 is released in the over-pressing position ÜS, a high force on the part of the ejection force storage member 4 becomes free whereby the spring force F rises to a high Newton value N even before the closed position SS is reached. As the same applies for the transmission of force from the ejection force storage member 4 to the locking pin 7 not only in the region between the over-pressing position ÜS and the closed position SS, but also for the substantially identical drawer travel movement region between the transitional region Ü and the latching region R, it will be apparent that, when the latching region R is reached by the ejection force storage member 4, a very high spring force F acts on the locking pin 7 and on the guide path 6 in the latching region R, which can cause loud knocking noises. In order to reduce that high transmission of force in that latching engagement movement region E either the travel transmission mechanism which has a damping effect in accordance with the first embodiment is provided or a damping device 8 (for example a linear damper) between the ejection force storage member 4 and the slider 15 is provided. For example, the damping device 8 can be integrated into the ejection force storage member 4 or connected in parallel therewith.

Figure 19:
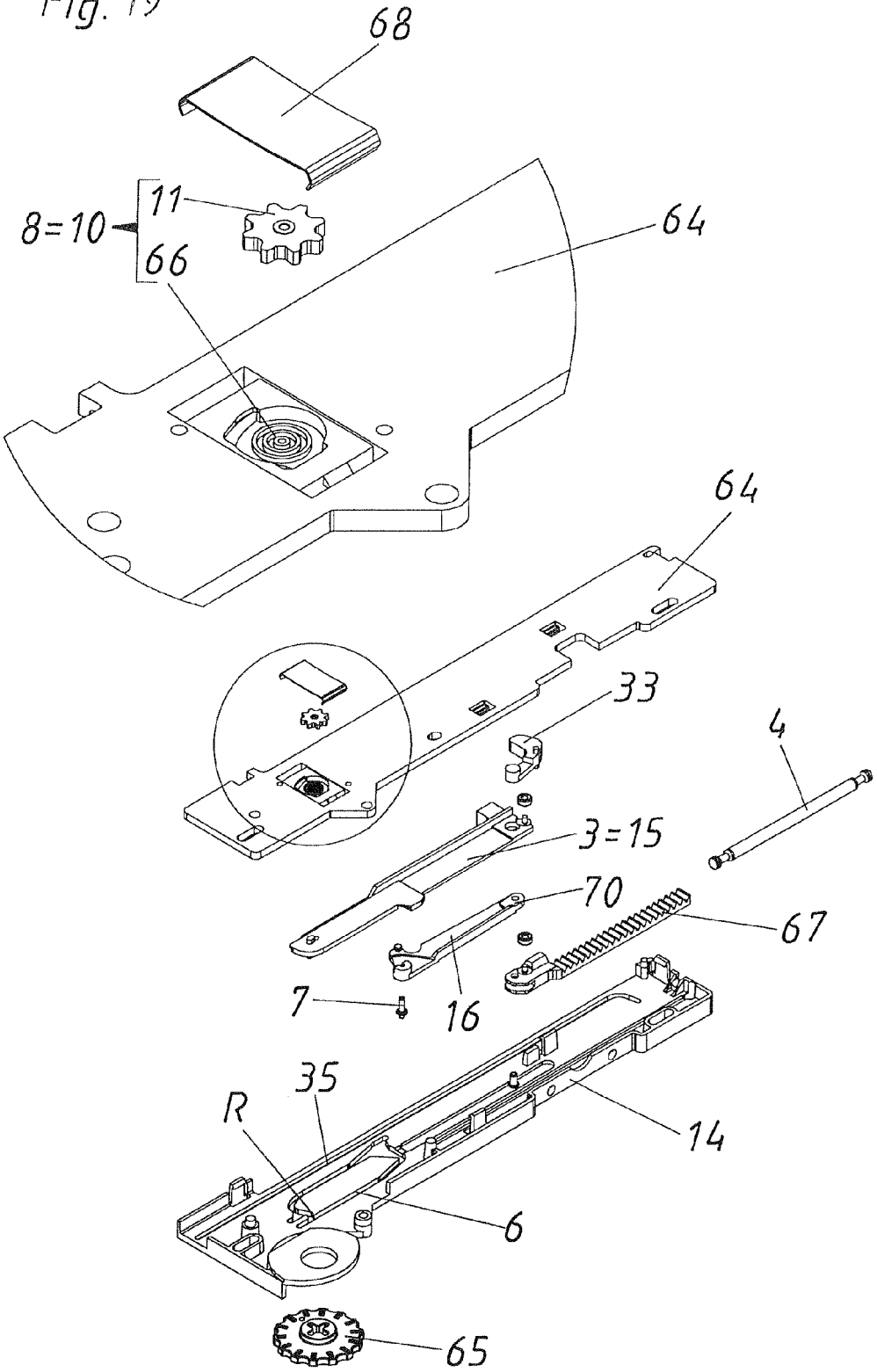
FIG. 19 is an exploded view of a second embodiment of the drive device.

A further embodiment of a drive device 1, in which the locking pin 7 can be placed in the latching region R in braked and/or damped relationship is shown as an exploded view in FIG. 19. In this case, once again the guide path 6 with latching region R is provided in the base plate 14. That base plate 14 can be displaced relative to the moveable furniture part 2 by way of the depth adjusting wheel 65 so that it is possible to adjust the front panel gap. The ejection element 33 or the slider 15 is mounted displaceably relative to the base plate 14 along the coupling element guide path 35. The coupling element 33 is also mounted pivotably on the slider 15. In addition, the synchronization element 67 is also connected to the slider 15. Drive devices 1 arranged on opposite sides of the moveable furniture part 2 can be coupled or synchronized by way of that synchronization element 67. The locking lever 16 is mounted rotatably or pivotably to the slider 15 by way of the locking lever pivot bearing 70. The locking pin 7 is also fixed to the locking lever 16. The ejection force storage member 4 is operative between the slider 15 and the base plate 14. In this embodiment, provided as an additional element is a base plate cover 64 in which the damping device 8 is provided. For that purpose, the base plate cover 64 has a gear rotary bearing 66 at which the gear 11 is rotatably mounted. That gear 11 and the gear rotary bearing 66 together with a damping medium therebetween form the rotational damper 10. To achieve a good connection between the gear 11 and the bearing 66, the arrangement has the holding element 68 which presses the gear 11 on to the bearing 66.

Figure 20:
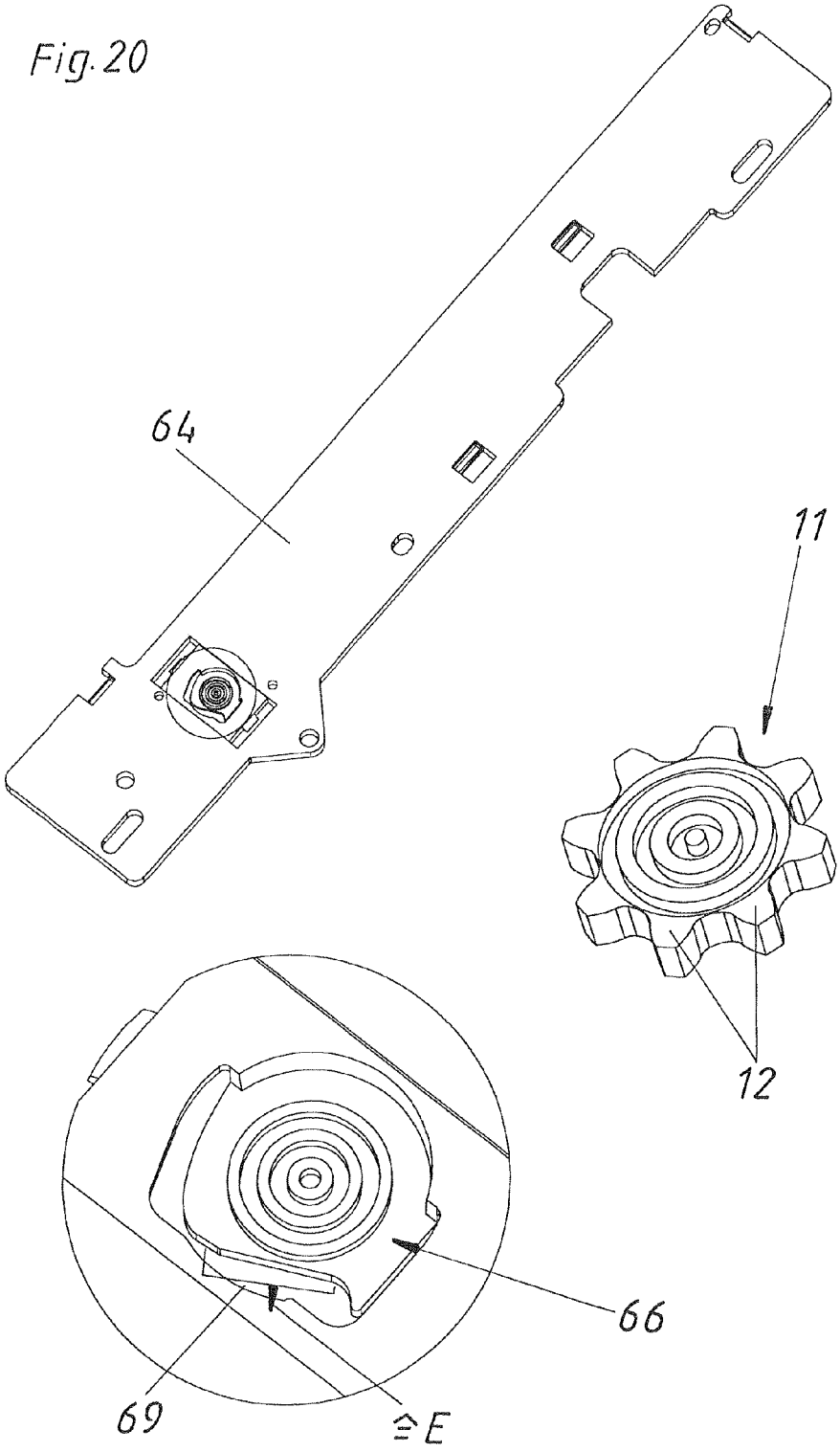
FIG. 20 shows details of the second drive device.

FIG. 20 is a detail view showing that the gear 11 and the bearing 66 have corresponding concentric grooves. To provide a good damping action, a suitable, preferably viscous damping medium, for example Opanol, is present in or introduced into those grooves. It can also already be seen from FIG. 20 that an opening 69 is provided in the base plate cover 64. The edge of that opening 69 substantially coincides with a part of the guide path 6 and is provided sufficiently accurately opposite or above that region of the guide path 6 in the base plate 14, in the base plate cover 64. The edge of the opening 69 therefore also corresponds in a region thereof to the latching engagement movement region E, into which, in the assembled condition, a tooth 12 of the gear 11 projects.

Figure 20A:
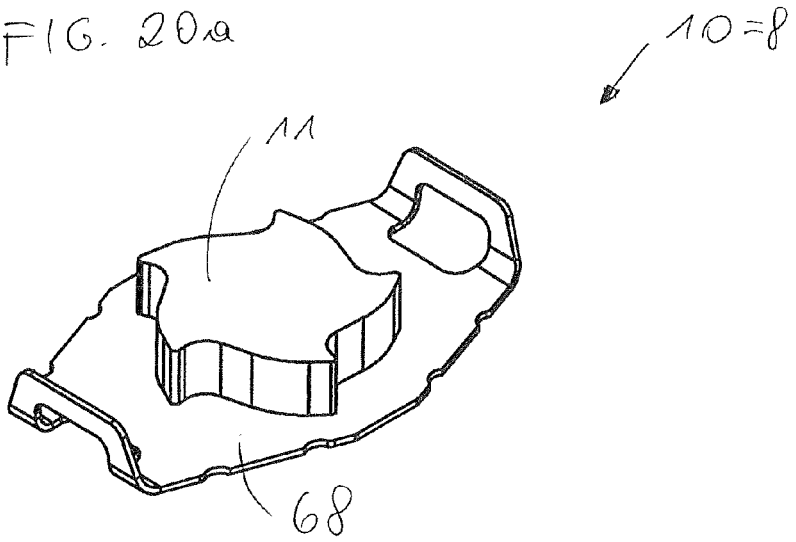
FIGS. 20*a*-20*g* show an embodiment of the damping device produced using two-component injection molding.
Figure 20B:
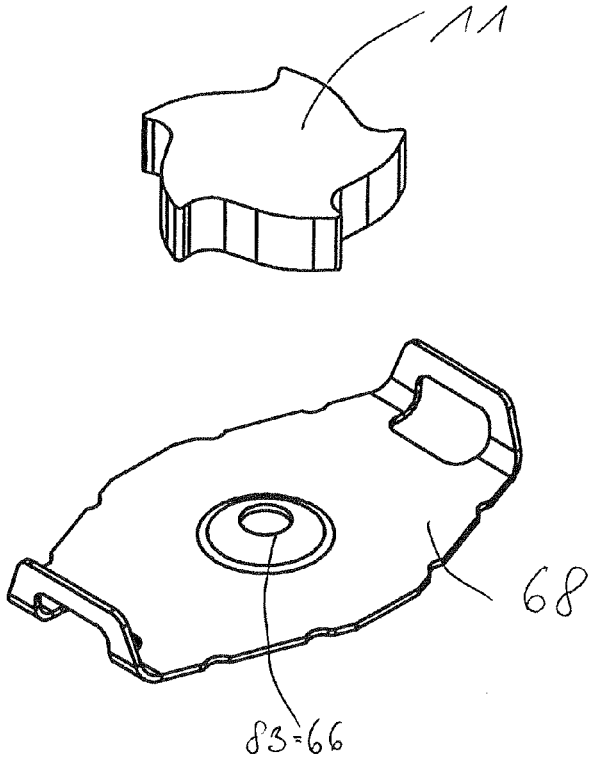
Figure 20C:
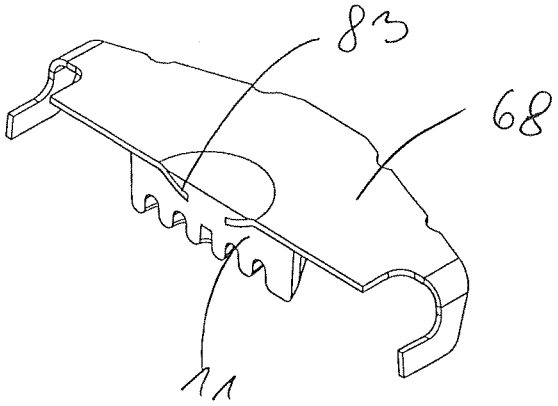
Figure 20D:
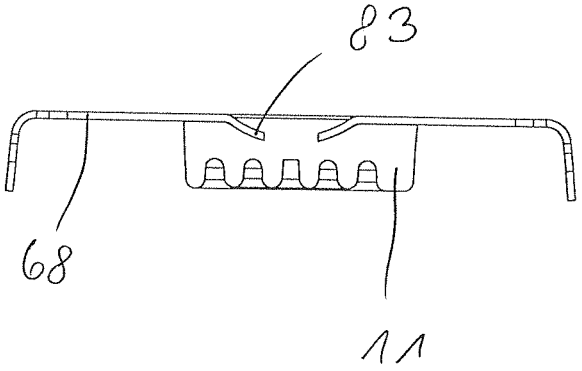
Figure 20E:
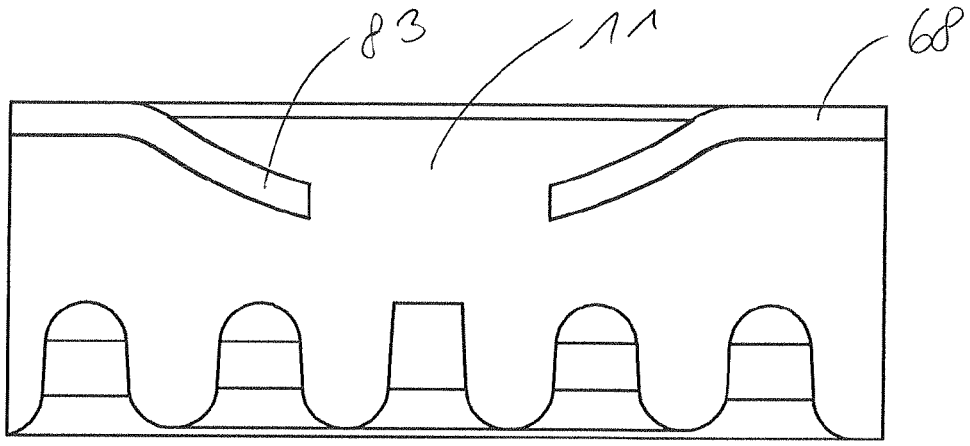
Figure 20F:
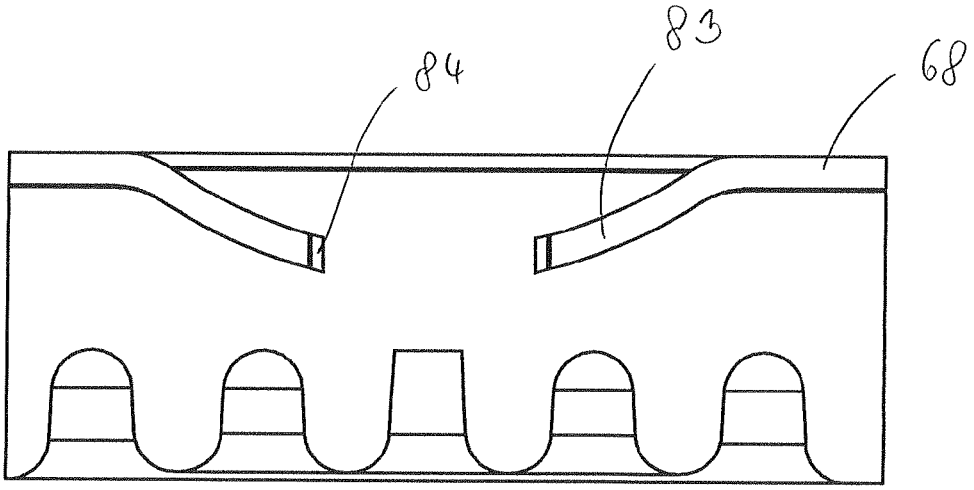
Figure 20G:
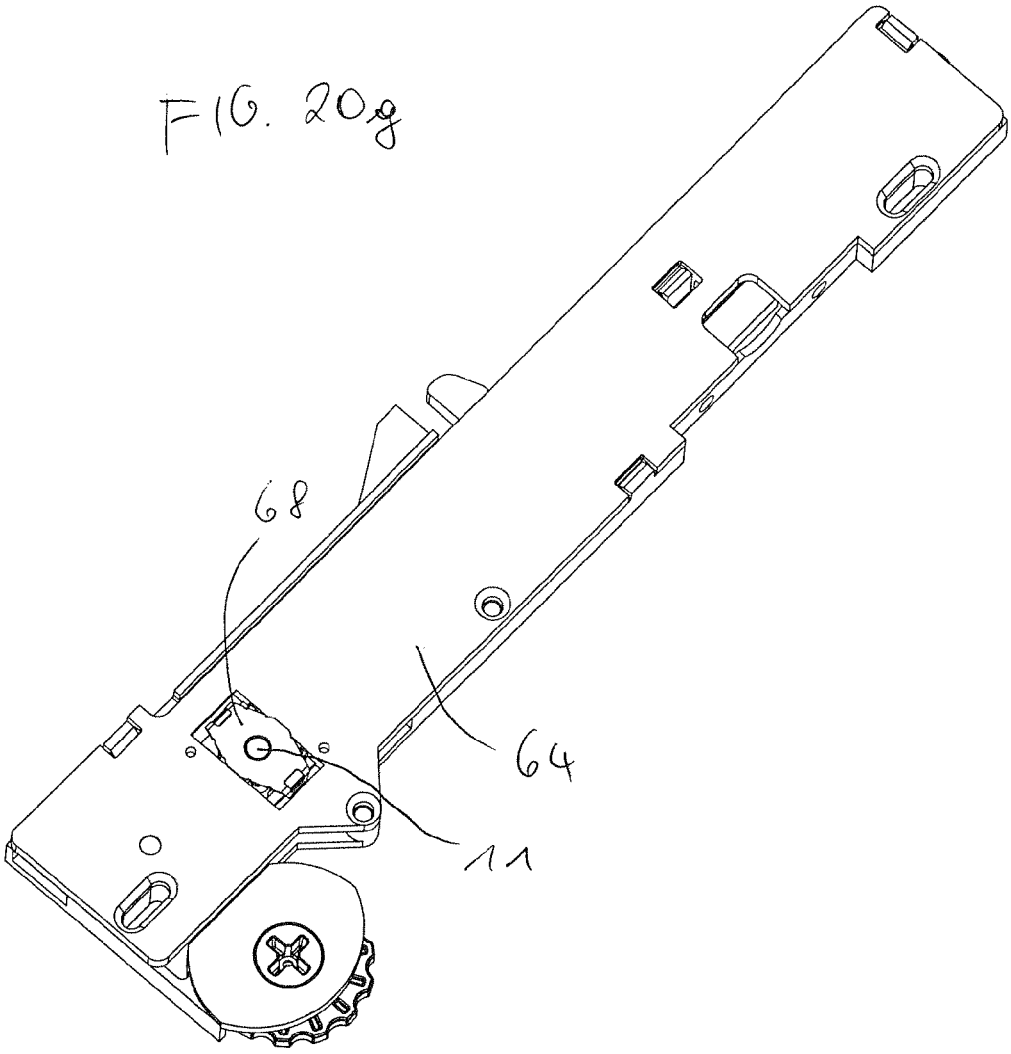
Figure 20H:
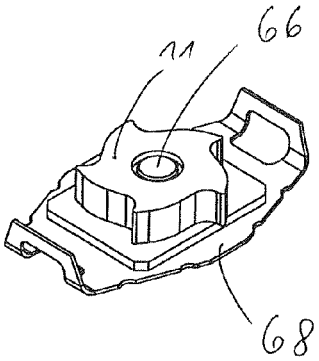
FIGS. 20*h*-20*k* show an embodiment of the damping device produced using multi-component injection molding.
Figure 20I:
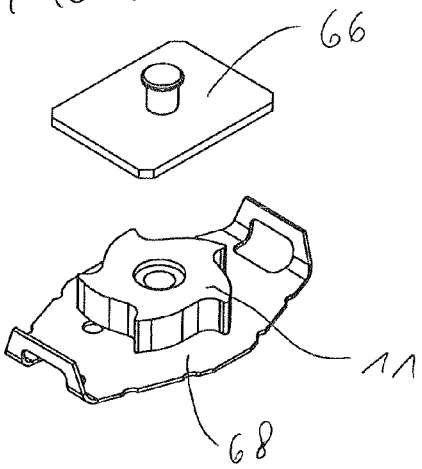
Figure 20J:
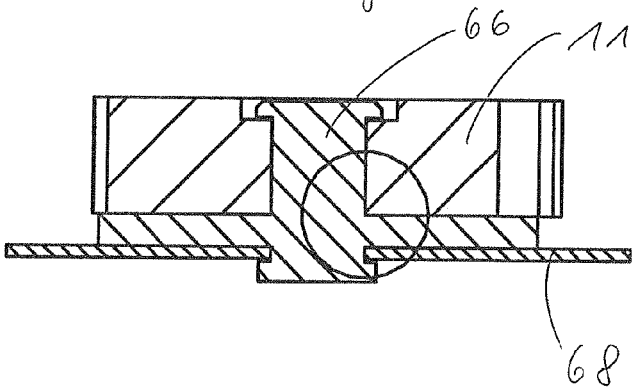
Figure 20K:
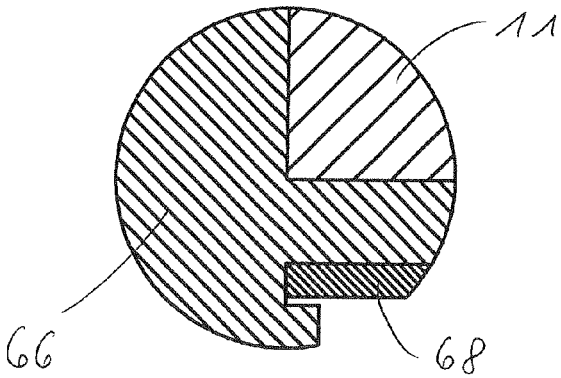

FIGS. 20*a* through 20*g* show a further embodiment of a damping device 8. In this variant, it is possible to dispense with the use of a damping medium insofar as the damping action is produced by friction between two components which are preferably produced in a two-component injection molding. FIGS. 20*a* and 20*b* show the star-shaped gear 11 and the holding element 68 which jointly form the rotational damper 10. The holding element 68 made from steel has a bent-up extension portion 83 and an opening, wherein the extension portion 83 at the same time forms the gear rotary bearing 66. It will be seen from the sections in FIGS. 20*c* and 20*d* that the extension 83 projects into the gear 11 which comprises plastic. Shortly after the two-component injection molding operation the bent-up extension portion 83 and the gear contact each other substantially over the entire surface (see FIG. 20*e*). Due to the contraction or shrinkage 84 of the plastic material after the injection molding operation the connection between the bent-up extension portion 83 and the gear 11 is at least partially released (see FIG. 20*f*). That results in an undersize in relation to the sheet metal thickness. As a result, the gear 11 can rotate relative to the holding element 68. The torque can be adjusted by adaptation of the wall thickness and the choice of material. FIG. 20*g* shows the damping device 8 in the installed condition on the base plate cover 64.

A possible design configuration for the damping device 8 in the form of a multi-component injection molding is shown in FIGS. 20*h* through 20*k*. In these views, the gear rotary bearing 66 is not in the form of part of the holding element 68, but is "added by injection" as a separate plastic part to the holding element 68 and projects through an opening in the holding element 68. A further plastic part forming the gear 11 is also mounted rotatably to that plastic part forming the bearing 66. The damping action is produced by friction between the gear 11 and the bearing 66.

A damping medium is no longer necessary with those design configurations for the damping device 8, there are slight torque fluctuations, there is a low degree of temperature sensitivity and a longer service life is achieved.

Figure 21:
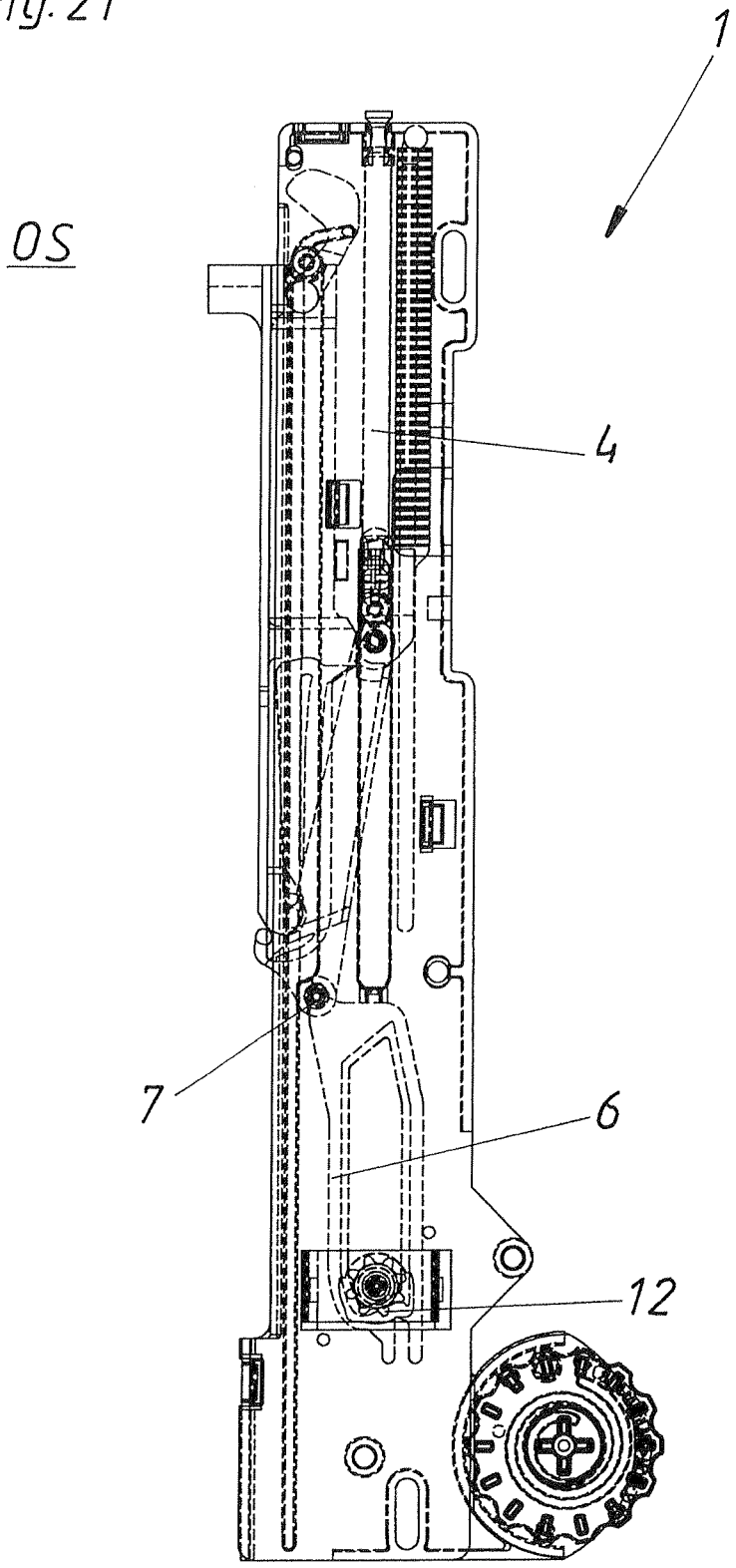
FIGS. 21 through 26 show a different position of the second drive device.

Referring to FIG. 21 the moveable furniture part 2 is in an open position OS, the locking pin 7 still being at the beginning of a stressing movement of the ejection force storage member 4. It is also already apparent that a tooth 12 of the gear 11 projects into the latching engagement movement region E of the guide path 6.

Figure 22:
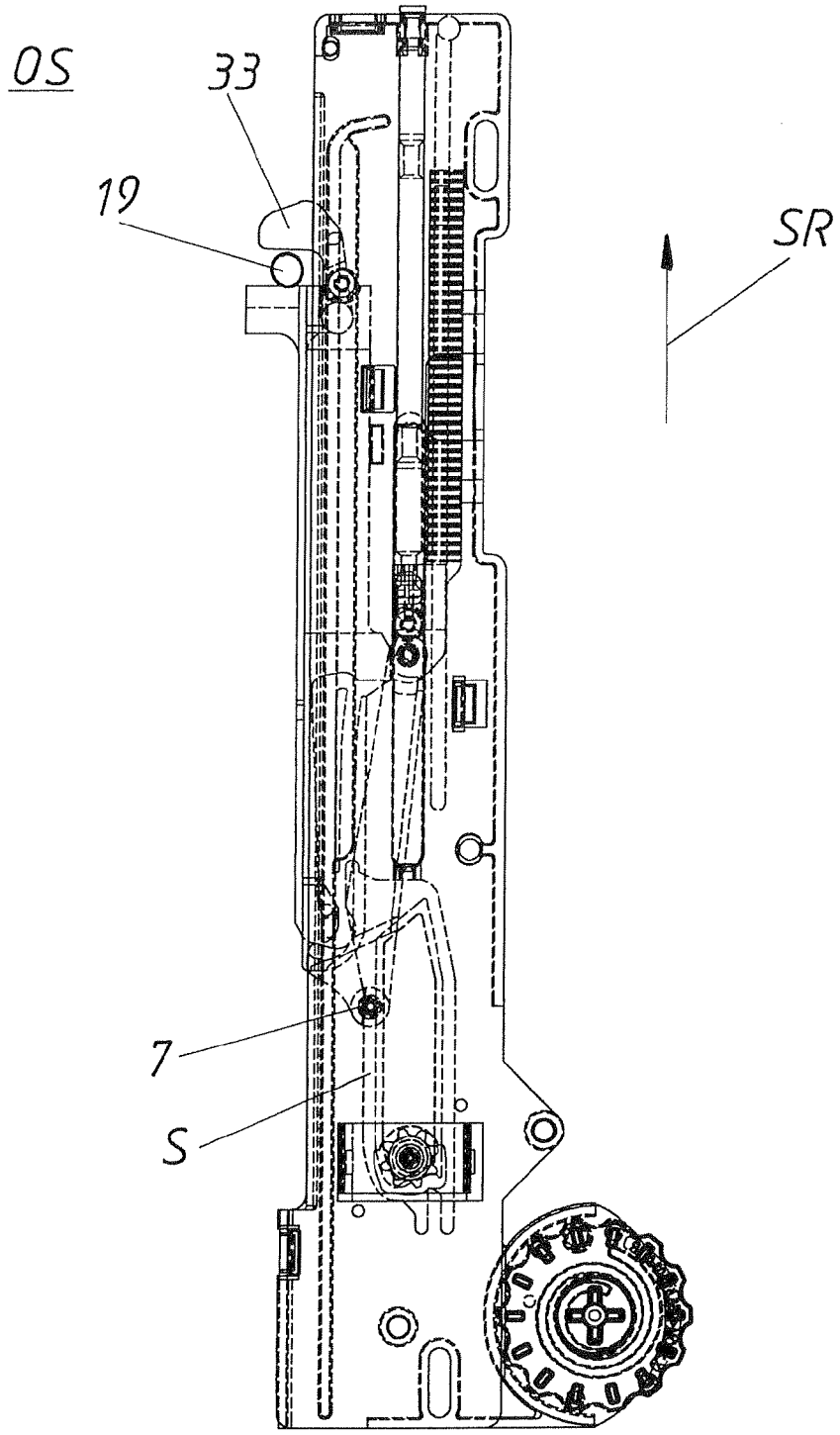

When now the moveable furniture part 2 is moved in the closing direction SR, the entrainment portion 19 is caught in the catch region 34 of the coupling element 33. At the same time, the locking pin 7 moves along the stressing portion S (see FIG. 22).

Figure 23:
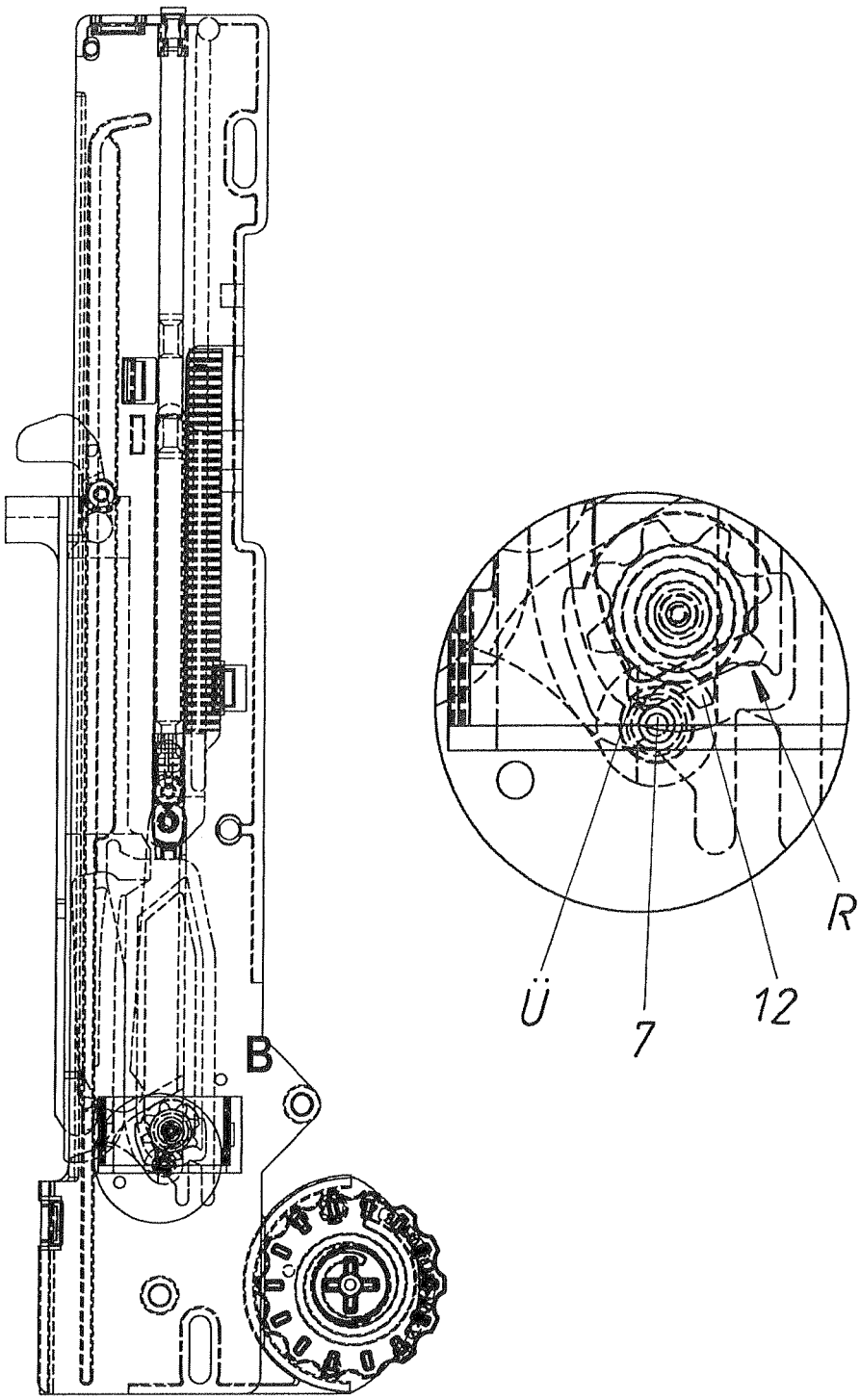

Referring to FIG. 23, the locking pin 7 has moved past the transitional region Ü and thereby passes into the latching engagement movement region E in which the full force of the ejection force storage member 4 acts on the locking pin 7. That force however can act only until the locking pin 7 bears against the tooth 12 projecting into the latching engagement movement region E. More specifically, as soon as the locking pin 7 bears against that tooth 12, the movement of the locking pin 7 is braked by virtue of the damping action of the rotational damper 10 and the locking pin 7 moves only slowly in the direction of the latching region R.

Figure 24:
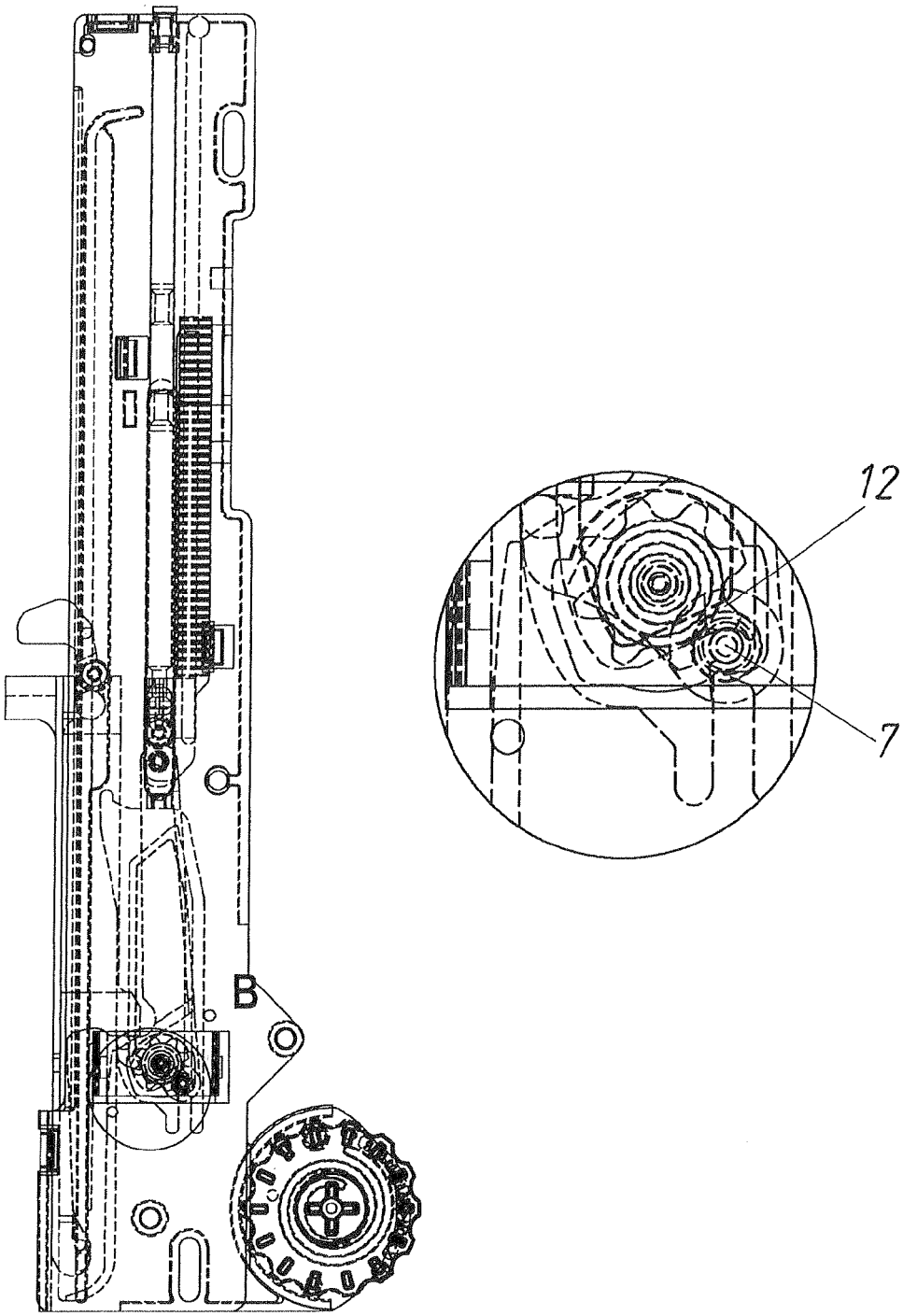

As soon as the gear 11 has moved in the counter-clockwise direction, with damping of the movement of the locking pin 7, until it no longer projects into the latching engagement movement region E, the locking pin 7 is in the latching region R of the guide path 6 as shown in FIG. 24. Thus, the movement of the locking pin 7 is braked at least in a part of the latching engagement movement region E by the damping device 8 in the form of the rotational damper 10.

Figure 25:
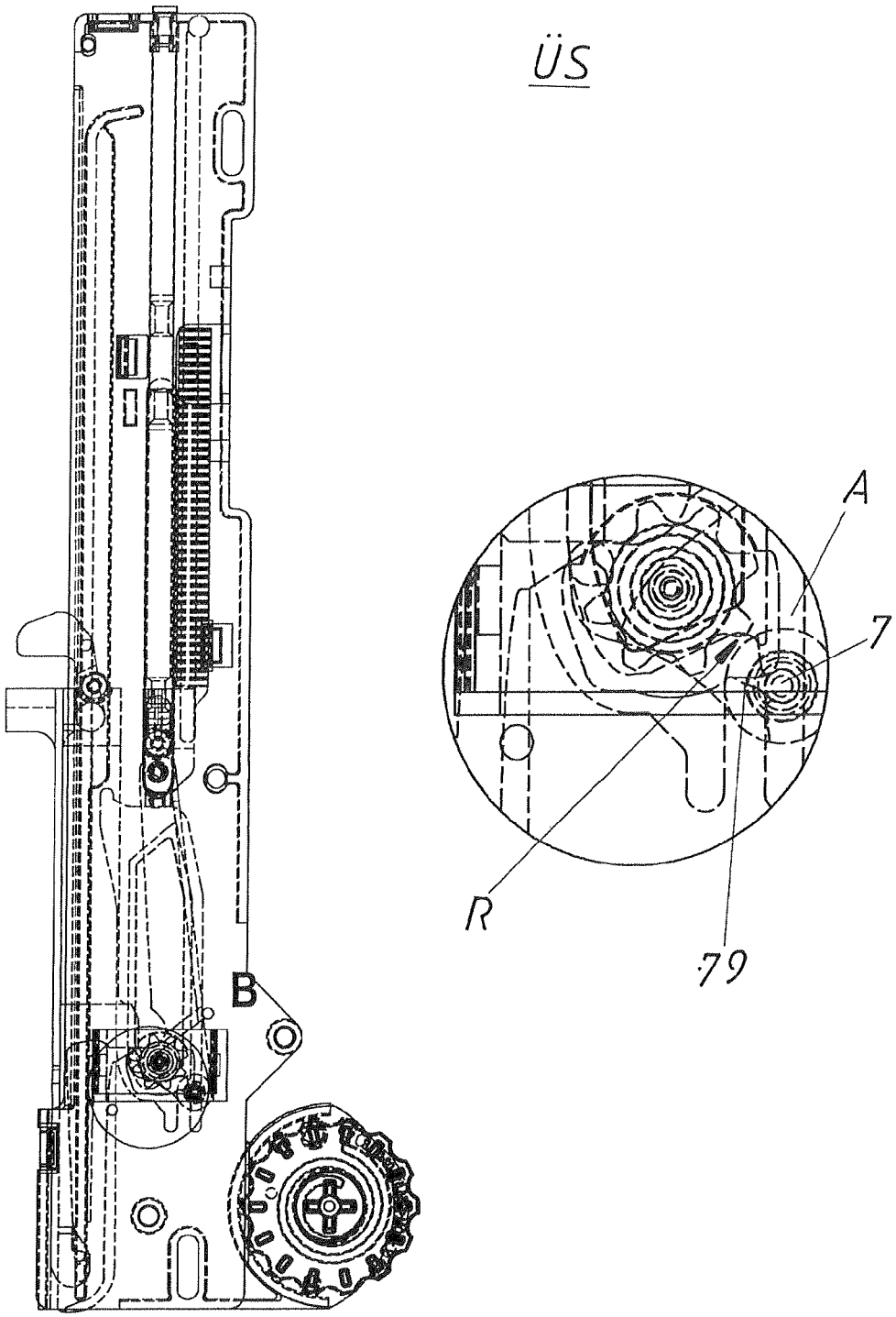

FIG. 25—as is known per se—shows the over-pressing position ÜS in which the locking pin 7 moves from the latching region R by way of the diversion surface 79 into the ejection portion A by over-pressing of the moveable furniture part 2 into an over-pressing position ÜS which is behind the closed position SS in the closing direction SR.

Figure 26:
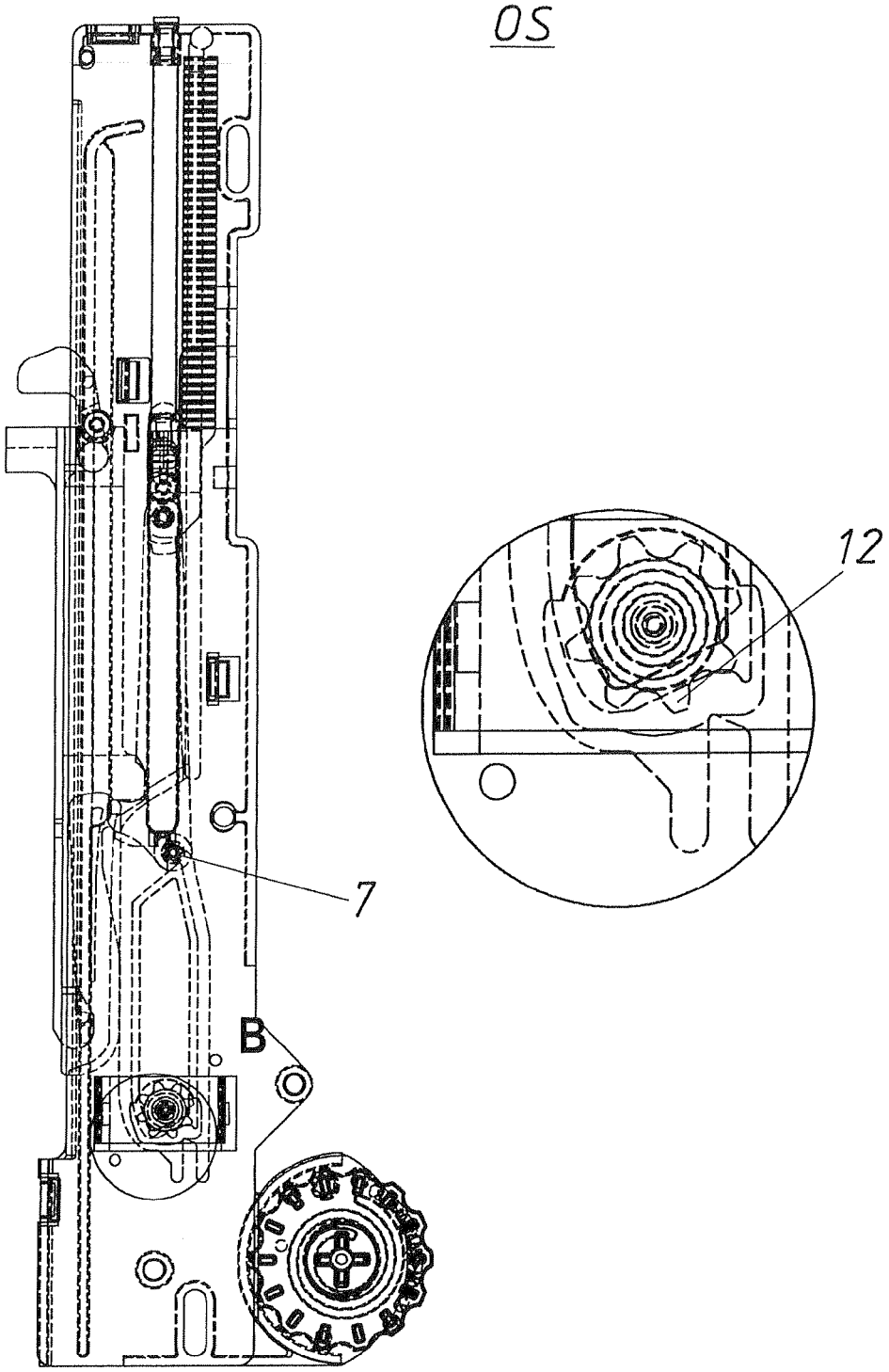

In FIG. 26, an open position OS is then again reached, in which the locking pin 7 passes into the region of the initial position again. A more detailed description of the remaining components and the remaining procedural movements of this embodiment as shown in FIGS. 19 through 26 will not be set forth here as the basic implementation substantially corresponds to the first embodiment and for that reason attention is correspondingly directed in substance thereto.

Figure 27:
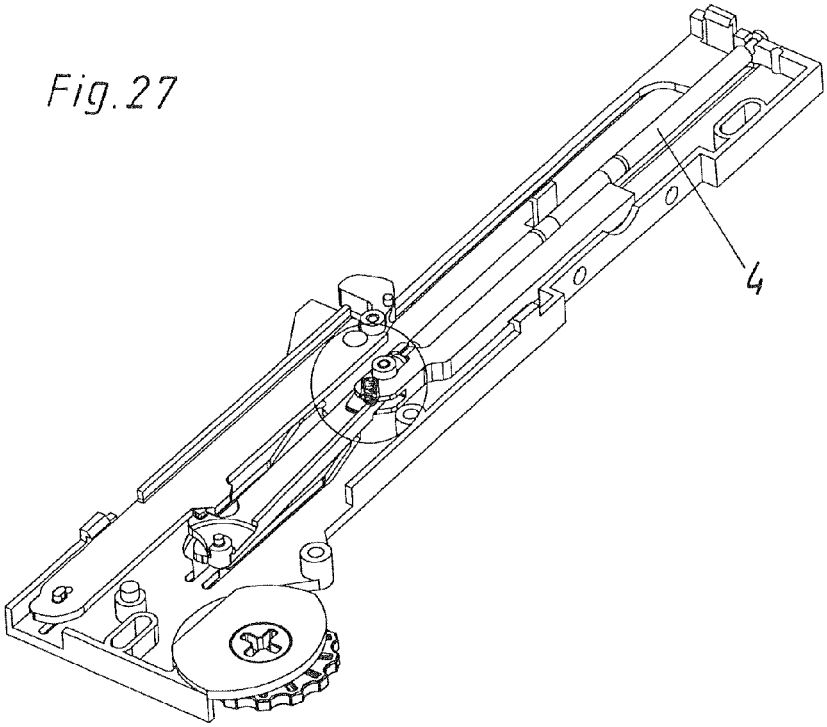
FIGS. 27 through 28 show a further embodiment of a damping device.
Figure 27:
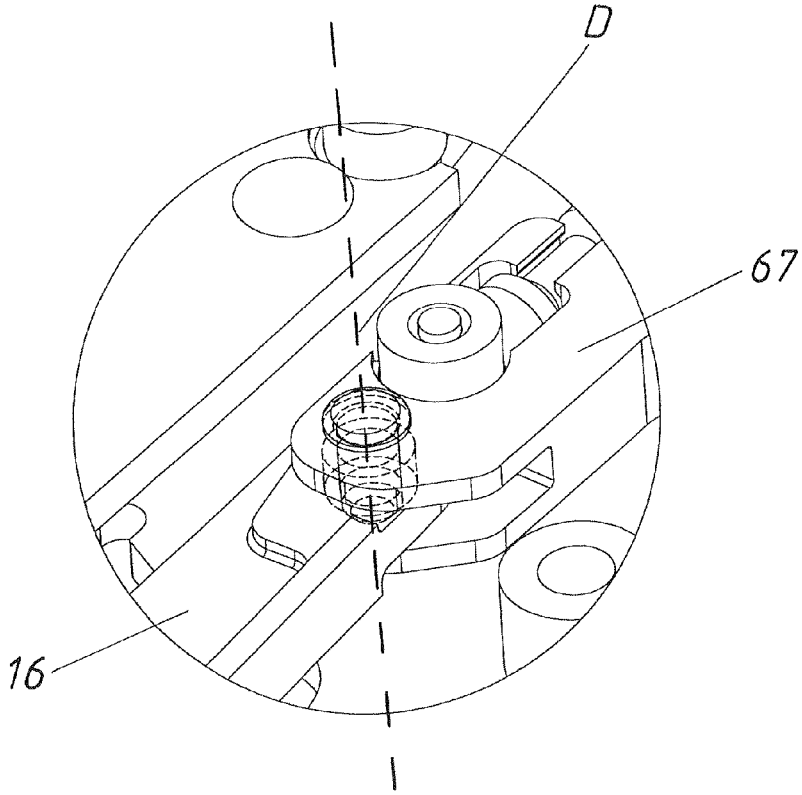
Figure 28:
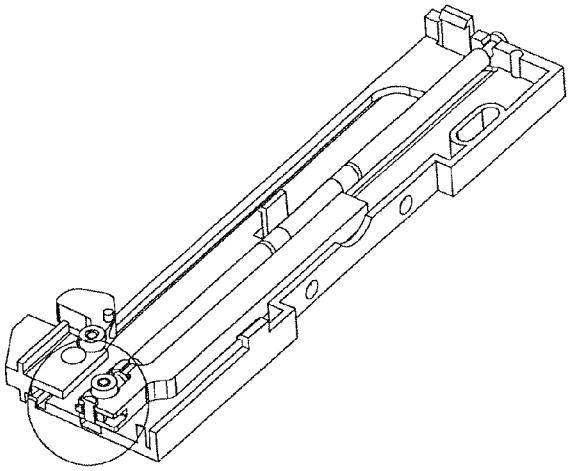
Figure 28:
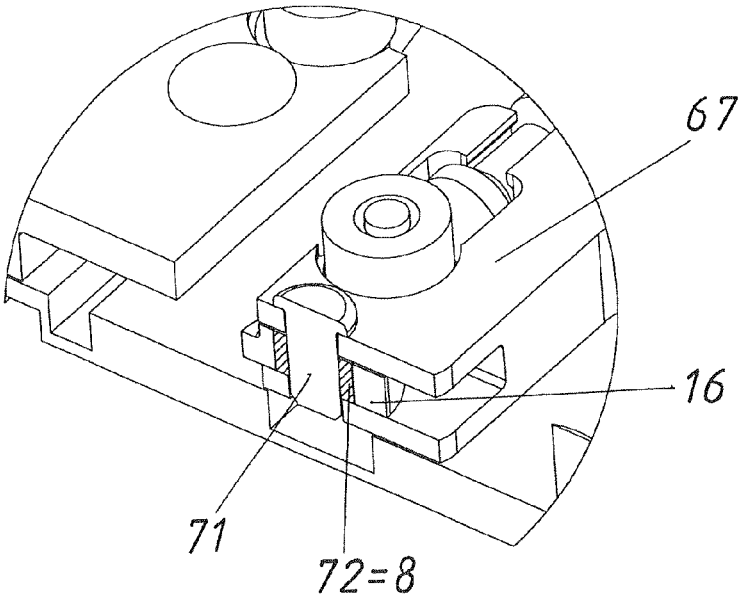

A further alternative embodiment of a possible way of placing the locking pin 7 in the latching region R in braked or damped relationship is shown in FIGS. 27 and 28. The basic structure in this embodiment also corresponds to the embodiment of FIGS. 19 through 26, and it is only the damping device 8 that is of a different configuration. In this embodiment, there is no rotational damper 10 in the region of the latching engagement movement region E, but the pivotal movement of the locking lever 16 is damped by a damping device 8. For that purpose, the damping device 8 is disposed in the region of the axis of rotation D of the locking lever 16 on the synchronization element 67 or on the slider 15. More specifically FIG. 28 shows a sectional view illustrating that a pin 71 forms the axis of rotation D for the locking lever 16. A friction brake 72 is arranged in an annular configuration between that pin 71 and the locking lever 16. The pivotal movement of the locking lever 16 can be damped by virtue of the fact that the friction brake 72 is very strongly clamped into the region between the locking lever 16 and the pin 71. As a result the locking pin 7 is moved in a reduced-speed movement along the latching engagement movement region E. It will be appreciated that other kinds of shaft dampers are also conceivable.

Figure 29:
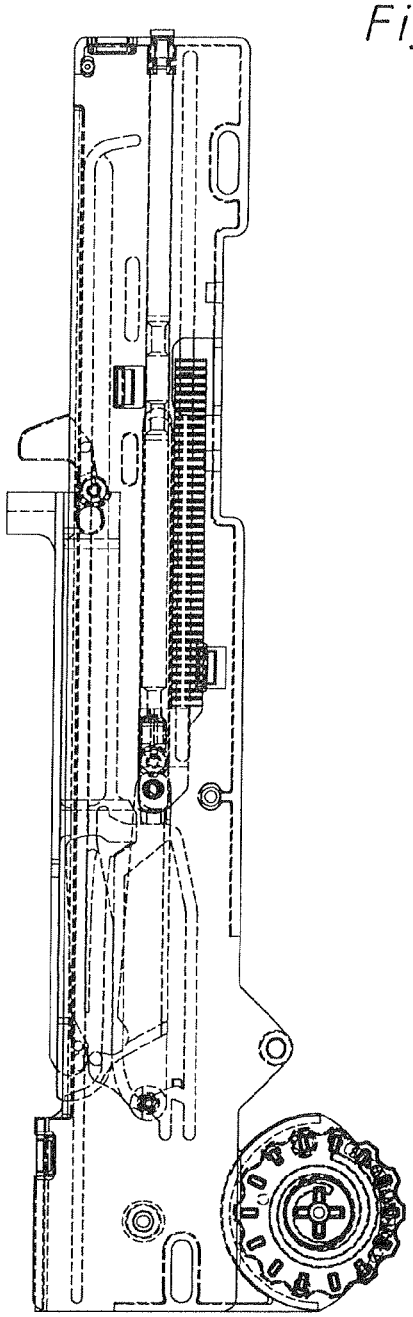
FIGS. 29 through 30 show a damping device in the form of a cushioned abutment, FIG. 31 diagrammatically shows the basic principle of the present invention.
Figure 29:
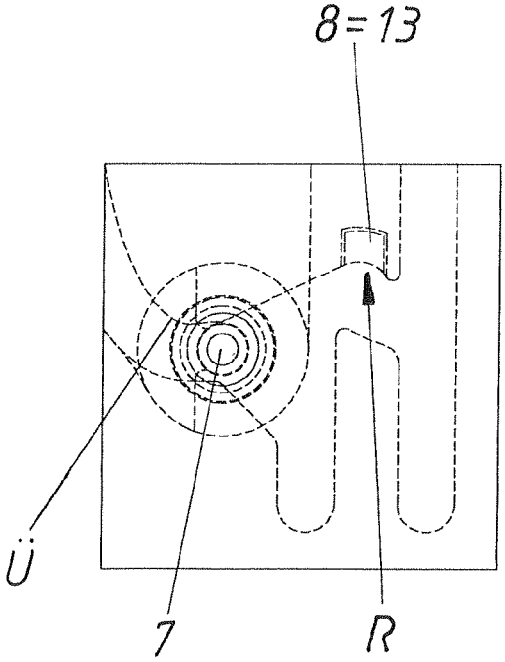
Figure 30:
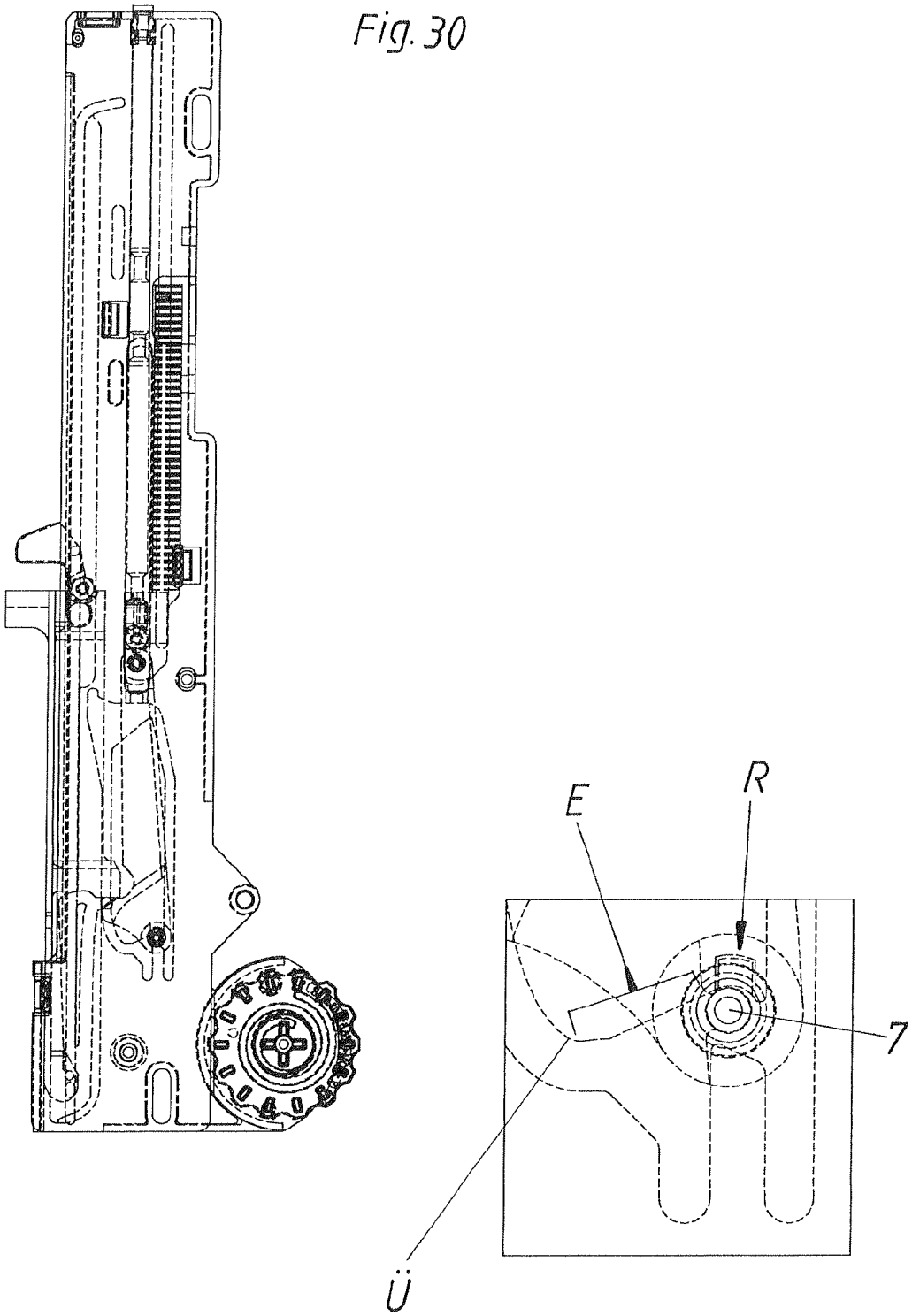

A further variant for moving the locking pin into the latching region R in braked or damped relationship is shown in FIGS. 29 and 30. In that case, the transmission of force from the ejection force storage member 4 to the slider 15 is not damped and also the locking pin 7 is not braked in the latching engagement movement region E, but rather provided in the latching region R is a damping device 8 in the form of a cushioning 13 or an elastically yielding element. In that respect, it can be seen from FIG. 29 how the locking pin 7, after passing beyond the transitional region Ü, reaches the latching engagement movement region E. In that region E, the locking pin 7 moves at full speed and under full load in the direction of the latching region R, where it arrives as shown in FIG. 30. To reduce the generation of noise, the cushioning 13 is provided in the latching region R. Abutting contact is damped thereby.

Figure 31:
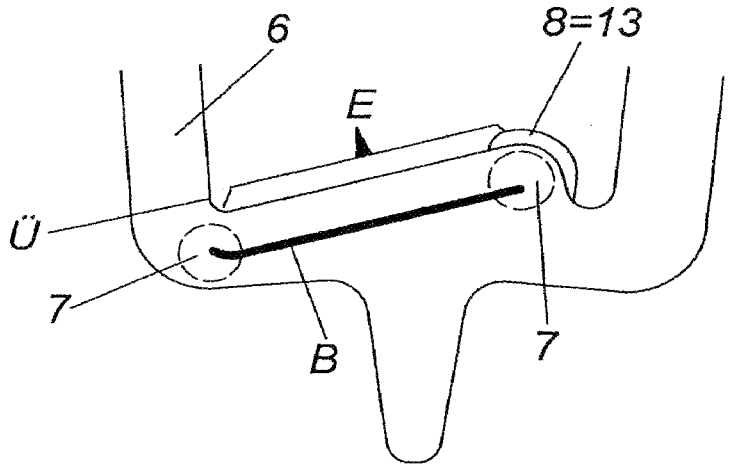

The fundamental concepts of the present invention are diagrammatically summarized once again in FIG. 31. It is essential that locking of the locking pin 7 in the latching region R of the guide path 6 is effected as quietly as possible.

For the purpose, in accordance with a first embodiment (FIGS. 3 through 18 and FIG. 32), there is provided a damped movement region B along the latching engagement movement region E. In this case, that can be effected by the fact that it is not the full force of the ejection force storage member 4 that acts on the locking pin 7 or the guide path 6, for example by way of a travel transmission mechanism or a linear damper, along that latching engagement movement region E.

In a further embodiment (FIGS. 19 through 28), the movement of the locking pin 7 in that movement region B can be braked at least portion-wise by a damping device 8 for example in the form of a rotational damper or a pivotal movement damper.

As a third variant (see also FIGS. 29 and 30), abutment in the latching region R can be damped in itself. For that purpose the damping device 8 can be in the form of a cushioning 13 or an elastic element fitted to the wall of the guide path 6.

Figure 34:
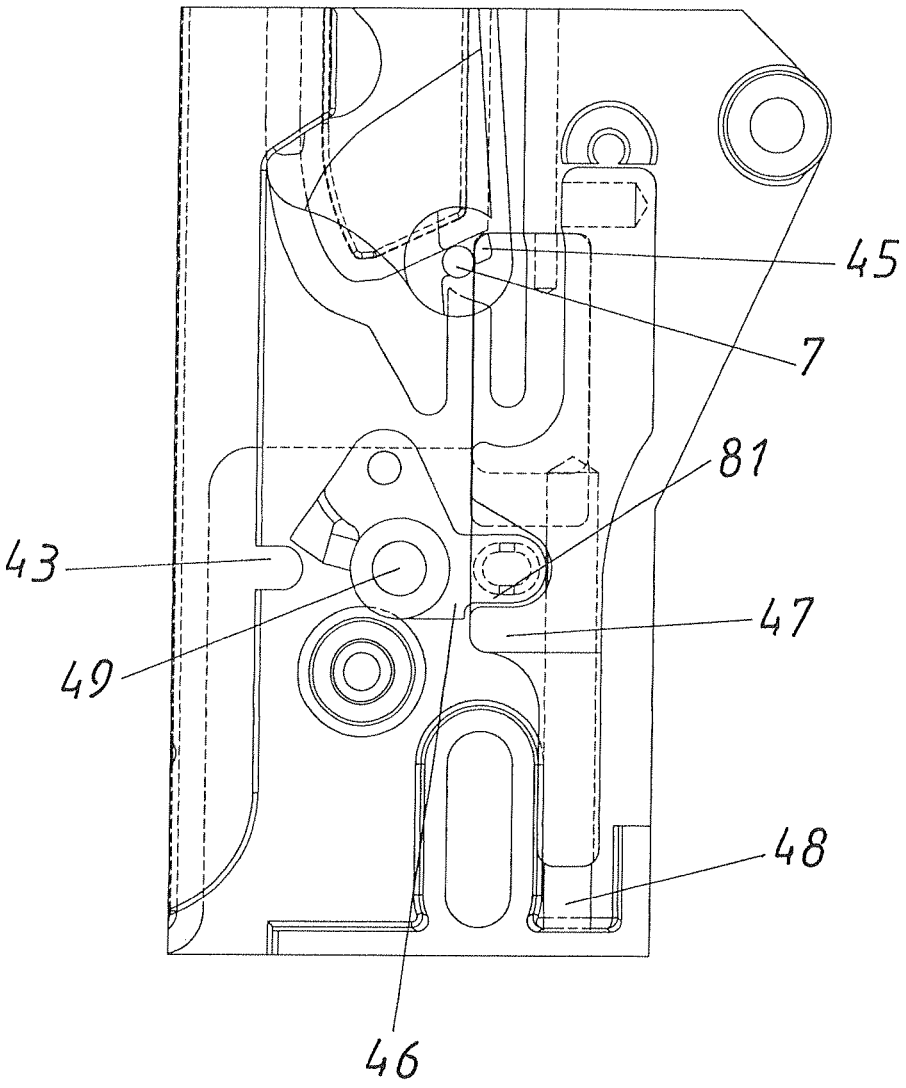
Figure 35:
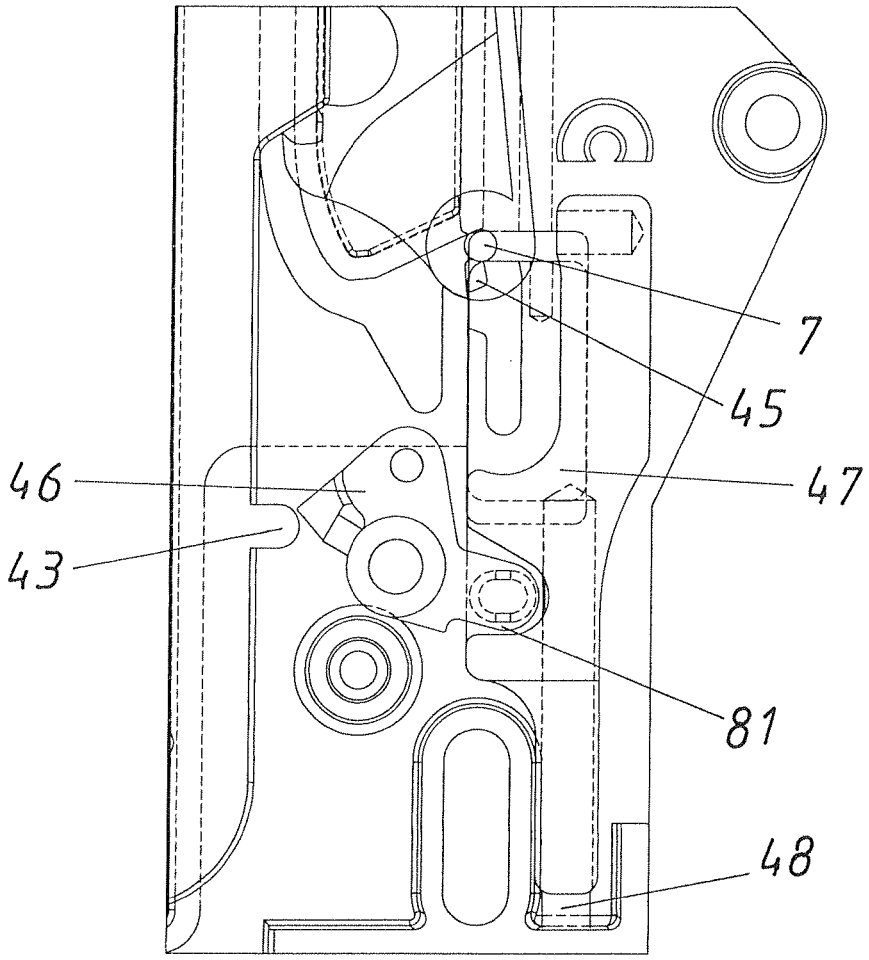
Figure 36:
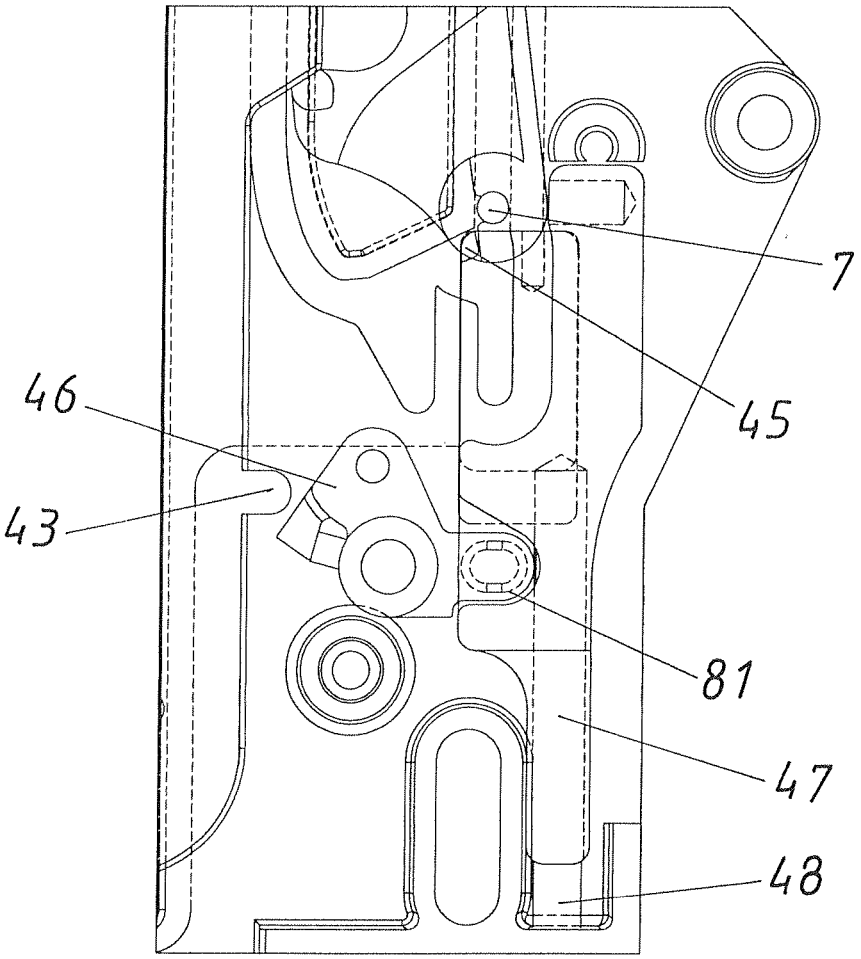
Figure 37:
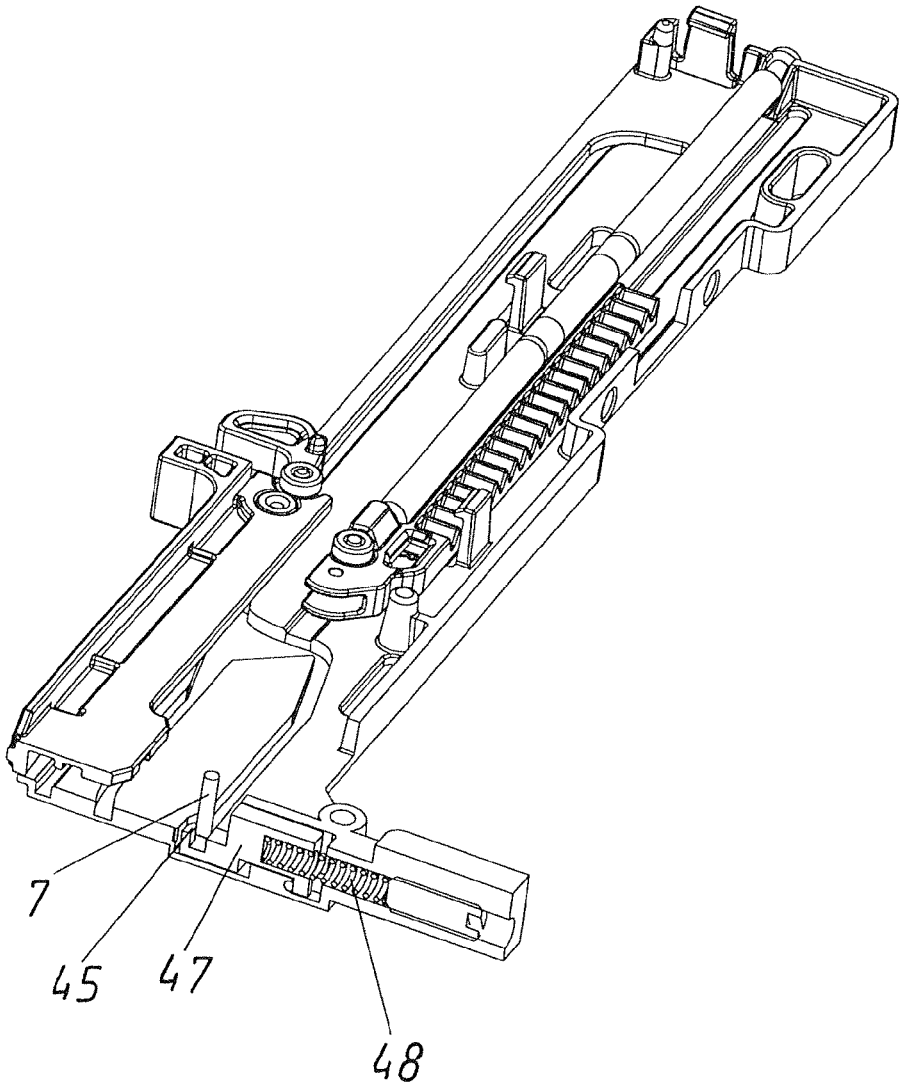

FIG. 13 shows an embodiment for unlocking and ejection by pulling. A further variant for unlocking by pulling is shown in FIGS. 33 through 36, whereby the drive device 1 has a pulling triggering element 46 rotatable about the rotary bearing 49. That triggering element 46 engages an arm 81 into an opening in the pulling triggering element 47. The locking abutment 45 is provided on that pulling triggering element 47. When, starting from the closed position SS as shown in FIG. 34 a pulling force is applied to the moveable furniture part 2 in the opening direction OR the pulling triggering element 46 is rotated by the abutment 43 in the clockwise direction about the bearing 49 so that, by way of the arm 81, the pulling triggering element 47 is moved against the force of the spring 48 (see FIG. 35). As a result, the locking abutment 45 is also moved and enables a passage for the locking pin 7. In that way, the ejection force storage member 4 can be relieved of stress and the moveable furniture part 2 is moved into an open position OS, in which case the locking pin 7 passes into the position shown in FIG. 36.

Figure 38:
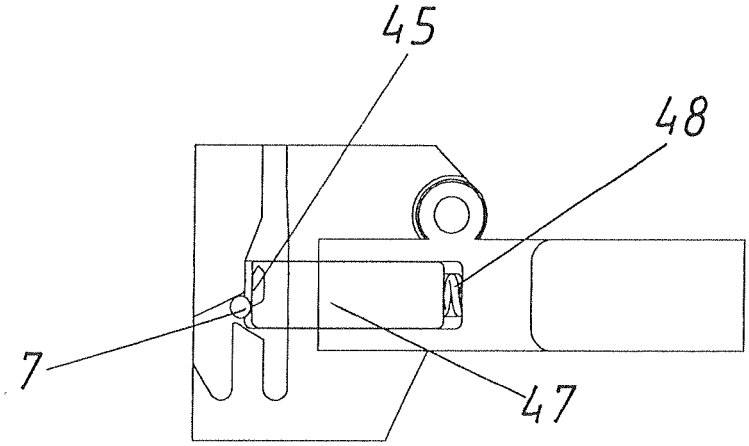
Figure 39:
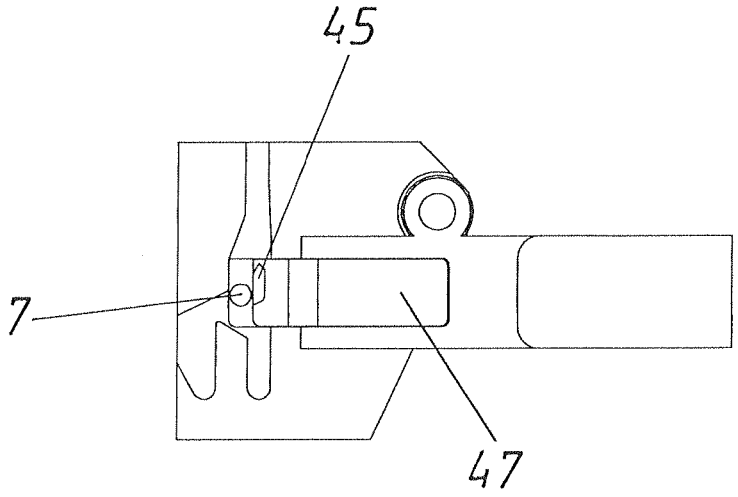
Figure 40:
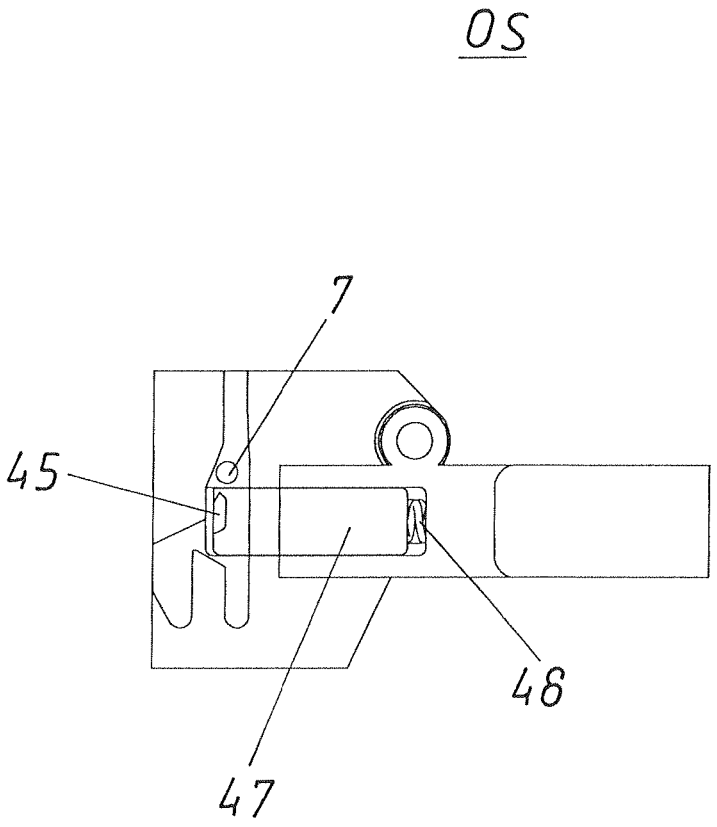

A further pulling triggering variant is shown in FIGS. 37 through 40 wherein the locking abutment 45 is provided on a pulling triggering element 47 moveable transversely relative to the closing direction SR. When, starting from the closed position SS as shown in FIG. 38, a pulling force is applied to the moveable furniture part 2 in the opening direction OR, then the locking pin 7 itself moves the pulling triggering element 47 together with the locking abutment 45 against the force of the spring 48 into the position shown in FIG. 39. This means that the locking pin 7 is no longer locked and a passage for the locking pin 7 is enabled or opened. The ejection force storage member 4 can then be relieved of stress and ejects the moveable furniture part 2 in the opening direction OR into an open position OS whereby the locking pin 7 passes into the position shown in FIG. 40.

The invention claimed is:

1. A drive device for a moveable furniture part, the drive device comprising:

an ejection element;

an ejection force storage member; and a locking device for locking the ejection element;

wherein the locking device has a locking pin to be acted upon by the ejection force storage member and lockable in a locking position in a latching region of a guide path; and wherein the latching region has a latching recess fixed in position relative to the guide path, the locking pin being configured to be acted upon by the ejection force storage member in a stressed condition of the ejection force storage member such that the locking pin can be placed in the latching region in a damped relationship.

2. The drive device as set forth in claim 1, wherein the guide path has a cardioid-shaped configuration.

3. The drive device as set forth in claim 2, wherein the cardioid-shaped guide path has a stressing portion in which the locking pin is moveable upon stressing of the ejection force storage member, and has a latching engagement movement region of the locking pin before the locking position in the latching region is reached.

4. The drive device as set forth in claim 3, wherein the latching region is spaced in the opening direction of the moveable furniture part from a transitional region between the stressing portion and the latching engagement movement region.

5. The drive device as set forth in claim 4, wherein the locking pin is configured to be completely uncoupled from a movement of the moveable furniture part as from attainment of the transitional region so that the locking pin is moveable into the latching region along the latching engagement movement region by the ejection force storage member.

6. The drive device as set forth in claim 1, further comprising a damping device operative between the ejection force storage member and the locking pin, the damping device being configured to damp the kinetic energy transmitted from the ejection force storage member into the locking pin before the locking position is reached.

7. The drive device as set forth in claim 6, wherein the kinetic energy acting on the locking pin is reduced by the damping device only in the latching engagement movement region of the locking pin.

8. The drive device as set forth in claim 6, wherein the damping device is in the form of a travel transmission mechanism.

9. The drive device as set forth in claim 8, wherein the locking pin and the guide path are configured such that the locking pin is placeable in the latching region in cam-controlled relationship by the travel transmission mechanism.

10. The drive device as set forth in claim 9, wherein the travel transmission mechanism has a control cam by which the kinetic energy acting from the ejection force storage member on the locking pin is steadily increased along the latching engagement movement region depending on the control cam.

11. The drive device as set forth in claim 6, wherein the damping device has a moveable damping element.

12. The drive device as set forth in claim 11, wherein the damping element includes a gear mounted in a damped rotary relationship, at least one tooth of the gear to be contacted by the locking pin in the latching engagement movement region and moveable in the direction of the latching region.

13. The drive device as set forth in claim 1, wherein the latching region has a damping device.

14. The drive device as set forth in claim 13, wherein the damping device is in the form of an elastic surface of the latching region.

15. The drive device as set forth in claim 1, wherein the ejection element includes a base plate and a slider, the slider being moveable relative to the base plate and lockable to the base plate by the locking device.

16. The drive device as set forth in claim 15, wherein the ejection force storage member is fixed to the base plate and to the slider.

17. The drive device as set forth in claim 15, wherein the locking pin is mounted rotatably to the slider by a locking lever and engages into the guide path in the base plate.

18. The drive device as set forth in claim 1, wherein the ejection force storage member is loadable by opening or closing the moveable furniture part.

19. An article of furniture comprising:

a furniture carcass;

a moveable furniture part moveable relative to the furniture carcass; and the drive device as set forth in claim 1 for moving the moveable furniture part.

20. The article of furniture as set forth in claim 19, wherein the drive device includes a base plate arranged on the moveable furniture part and an entrainment portion to be brought into engagement with the ejection element of the drive device, the entrainment portion being arranged on the furniture carcass.

21. The drive device as set forth in claim 1, wherein the latching recess comprises a wall fixed in position relative to the guide path, the drive device further comprising a damping device comprising an elastic element fitted to the wall of the latching recess.

22. The drive device as set forth in claim 4, wherein the latching region is spaced in the opening direction of the moveable furniture part from the transitional region by a distance between 0.2 mm and 3.0 mm.

23. The drive device as set forth in claim 11, wherein the moveable damping element is a rotational damper.

24. The drive device as set forth in claim 14, wherein the elastic surface of the latching region is in the form of a cushioning.

25. The drive device as set forth in claim 16, wherein the ejection force storage member is in the form of a tension spring.

* * * * *